US008712314B2

(12) United States Patent
Kubo et al.

(10) Patent No.: US 8,712,314 B2
(45) Date of Patent: Apr. 29, 2014

(54) METHOD OF SHEET ALIGNMENT AND METHOD OF POST-PROCESSING COMPRISING THE SAME AND METHOD OF IMAGE FORMATION

(75) Inventors: Eiichi Kubo, Nishiyatsushiro-gun (JP); Masato Hosaka, Minami-Alps (JP)

(73) Assignee: Nisca Corporation, Minamikoma-gun, Yamanashi (JP)

( * ) Notice: Subject to any disclaimer, the term of this patent is extended or adjusted under 35 U.S.C. 154(b) by 0 days.

(21) Appl. No.: 12/929,202

(22) Filed: Jan. 7, 2011

(65) Prior Publication Data

US 2011/0103859 A1 May 5, 2011

Related U.S. Application Data

(63) Continuation of application No. 11/896,692, filed on Sep. 5, 2007, now abandoned.

(30) Foreign Application Priority Data

Sep. 22, 2006 (JP) ..... 2006-257524

(51) Int. Cl.
*G03G 15/00* (2006.01)
*B65H 9/00* (2006.01)

(52) U.S. Cl.
USPC ..... 399/407; 399/405; 271/236; 271/228; 271/242; 271/252; 271/221

(58) Field of Classification Search
USPC ..... 399/407–410, 405; 271/236, 228, 242, 271/252, 221
See application file for complete search history.

(56) References Cited

U.S. PATENT DOCUMENTS 4,257,587 A * 3/1981 Smith ..... 271/236

FOREIGN PATENT DOCUMENTS

| | | | |
|---|---|---|---|
| JP | S61-172702 A | | 8/1986 |
| JP | 2002-068574 A | | 3/2002 |
| JP | 2002193535 A | * | 7/2002 |
| JP | 2003128332 A | * | 5/2003 |
| JP | 2005-314092 A | | 11/2005 |
| JP | 2006-027863 A | | 2/2006 |

* cited by examiner

*Primary Examiner* — Matthew G Marini
(74) *Attorney, Agent, or Firm* — Manabu Kanesaka

(57) ABSTRACT

A method of a sheet alignment includes carrying a sheet from a sheet discharging port; transferring the sheet on a tray device toward a sheet end regulating device; moving the sheet on the tray device in a width direction orthogonal to the sheet discharging direction for widthwise alignment; and abutting again the sheet on the tray device against the sheet end regulating device while the sheet is in the widthwise alignment. When the sheet on the tray device is transferred toward the sheet end regulating device, the sheet is transferred at a predetermined speed. Before the sheet abuts against the sheet end regulating device, the speed is reduced to provide a conveying force to the sheet without stopping. While the conveying force is continuously applied to the sheet, the sheet is aligned in the width direction to thereby prevent skewing of the sheet relative to the sheet end regulating device.

9 Claims, 22 Drawing Sheets

METHOD OF SHEET ALIGNMENT AND METHOD OF POST-PROCESSING COMPRISING THE SAME AND METHOD OF IMAGE FORMATION

CROSS-REFERENCE TO RELATED APPLICATIONS

The present application is a continuation application of U.S. Ser. No. 11/896,692 filed on Sep. 5, 2007. The application claims priority to Japanese patent application number 2006-257524 filed on Sep. 22, 2006, which is incorporated by reference in its entirety."

BACKGROUND OF THE INVENTION AND RELATED ART STATEMENT

The present invention relates to a method of a post-processing receiving a sheet with an image formed thereon by a method of image formation using such as a copier or a printing machine, executing a post-process such as stapling, punching, or stamping on the sheet, and a method of sheet alignment placing the sheet at the post-process position in a predetermined posture.

In general, sheet aligning devices of this kind are widely known to place sheets with images formed thereon by an image forming apparatus, on a tray in a predetermined posture for alignment, to execute a post-process such as stapling, stamping, or punching on the sheets and accommodate the sheets in a downstream housing stacker. The processing tray thus requires a sheet aligning mechanism that places each sheet at a predetermined position for alignment so that the sheets can be subjected to the post-process.

Such a sheet aligning mechanism has been incorporated into a post-processing apparatus such as the one disclosed in, for example, Patent Document 1 (Japanese Patent Laid-Open No. 2003-128332 (FIGS. 2 and 4)). According to the publication, sheets processed by the image forming apparatus are stacked and set on the processing tray through a sheet discharging port. A stable device located on the tray then staples and discharges the sheets to a housing tray located downstream of the processing tray. The processing tray thus comprises a conveying roller that can rotate forward and backward to carry a sheet from the sheet discharging port downstream along the processing tray. Once a trailing edge of the sheet is guided onto the tray, a roller is reversely rotated to switch back the sheet.

The processing tray further has a trailing end regulating member against which trailing ends of sheets are controllably abutted to stack the sheets with their trailing ends appropriately positioned. Although not shown in the drawings of the publication, the processing tray has a sheet widthwise aligning plate that controllably places a sheet at an appropriate position in a direction orthogonal to a conveying direction for widthwise alignment; the sheet widthwise aligning plate places one side of the sheet at a reference position. A sheet from the sheet discharging port is stacked and set on other sheets on the processing tray, and at the same time, placed at a predetermined position for alignment.

Further, in order to prevent a sheet from being buckled or bent and curled by the regulating member, for example, Patent Document 2 (Japanese Patent Laid-Open No. 2002-193535 (FIG. 17)) discloses a sheet aligning mechanism that reduces a sheet conveying speed to abut the sheet against a regulating device (end fence) to prevent the sheet from being buckled or bent.

Furthermore, to allow a large number of sheet bundles to be distributed and arranged in order, for example, Patent Document 3 (Japanese Patent Laid-Open No. 2000-034051 (FIGS. 6 and 8)) discloses a jog device in a sheet handling apparatus comprising a sheet accommodating device on which a plurality of discharged sheets is stacked and accommodated the form of sheet bundles and a stacker in which the sheet bundles discharged by the sheet accommodating device are sequentially housed. With the jog device, every time the sheet accommodating device discharges a sheet, the sheet is placed at an appropriate position for alignment. As a result, the sheet is accommodated at a reference position. The sheet bundles are distributed on the sheet discharging stacker at alternately displaced positions.

As described above, to sequentially stack the sheets on the tray such as the processing tray while placing each sheet at a predetermined position for alignment, the conventional techniques require the sheet transfer device and the widthwise aligning member to act simultaneously on the sheet; the sheet transfer device transfers the sheet on the tray toward the sheet end regulating member, and the widthwise aligning device places the sheet at the appropriate position in the direction orthogonal to the conveying direction for widthwise alignment. The sheet transfer device is composed of a rotating member such as a roller or a belt. The widthwise aligning device is composed of an aligning plate that engages with a side edge of the sheet to movably press the sheet.

Thus, the conventional techniques require the sheet transfer device and the aligning device to simultaneously act in a conveying direction and in a direction orthogonal to the conveying direction. This allows the sheet transfer device to be easily kept in pressure contact with a sheet. Thus, when the sheet is placed at the appropriate position in the width direction, a rotating force may disadvantageously act on the sheet as a result of the relationship between a sheet centroid position, varying with the sheet size, and a sheet widthwise aligning position set by the aligning device. As a result, the aligning operation may result in the sheets inclined on the tray (skew state).

For example, as shown in FIG. 12, sheet transfer device 50 causes a conveying force F1 to act in the conveying direction (in the figure, the direction opposite to a sheet discharging direction). At the same time, widthwise aligning device 51 causes a conveying force F2 to act in the orthogonal direction below a sheet centroid position G1. At this time, since the conveying force F2 of the widthwise aligning device 51 is weaker than the conveying force F1 of the sheet transfer device 50, when one end a1 of a sheet is placed at a position a2 for widthwise alignment, a rotating force acts to move the sheet centroid position G1 to a position G2 to move the other end b1 of the sheet to a position b2. As a result, the sheet is rotated as shown in the figure and thus placed in an incorrect position, resulting in an inappropriate post-process.

Further, it is assumed that the sheet transfer device 50 exerts a strong conveying force (for example, high-speed conveyance) on a sheet. Then, for a thick sheet, the sheet abutting against a sheet trailing end regulating member 52 rebounds and is thus placed in an incorrect position. For a thin sheet, the sheet abutting against the sheet trailing end regulating member 52 has its leading end bent and is thus skewed during an aligning operation. Such a misaligned sheet causes an inappropriate post-process, for example, a stapling process.

The present inventors solve the leading end bending problem and the rebounding problem by placing the leading end (or trailing end) of a sheet along a regulating member on the tray, feeding the sheet at a high speed when the sheet is placed at an appropriate position in the width direction using a center reference or a side reference and then reducing speed immediately before the trailing end of the sheet reaches the regulating member. After the sheet is abutted against the regulating member, widthwise aligning device moves the sheet in the orthogonal direction for widthwise alignment. In the present invention, it is therefore suggested that a conveying force, acting in a direction in which the leading end of the sheet abuts against the regulating member during the above widthwise aligning movement, is applied to the sheet, and the sheet is prevented from being skewed by being placed along the regulating member.

Therefore, a main object of the present invention is to provide a method of a sheet alignment that, when a sheet is placed at an appropriate position on a tray for alignment, prevents the sheet abutting against a regulating member from being rebounded or curled and skewed during widthwise alignment.

Another object of the present invention is to increase an operating speed of an image forming apparatus and a post-processing apparatus that can orderly stack sheets on the tray after processed by the image forming apparatus and then execute a post-process on the sheets.

Further objects and advantages of the invention will be apparent from the following description of the invention.

SUMMARY OF THE INVENTION

The present invention adopts the following configuration in order to accomplish the above objects. A method of sheet alignment comprises using a sheet aligning device, which comprises a sheet discharging port out of which sheets are sequentially carried, a tray device on which the sheets from the sheet discharging port are stacked and accommodated, a sheet end regulating device against which a sheet-discharging-wise leading or trailing end of each the sheets on the tray device is controllably abutted, a sheet transfer device for transferring the sheet on the tray device toward the sheet trailing end regulating device, a widthwise aligning device for moving the sheet on the tray device in a direction orthogonal to a sheet discharging direction for widthwise alignment, and a control device for allowing the sheet transfer device to abut the sheet on the tray device against the sheet regulating device and allowing the widthwise aligning device to place the sheet at an appropriate position in a width direction.

The sheet transfer device is configured to be able to adjust a conveying force applied to the sheet on the tray device. The control device is configured so that (1) when the sheet on the tray device abuts against the sheet end regulating device, the conveying force applied to the sheet by the sheet transfer device is reduced and (2) after the sheet abuts against the sheet end regulating device and when the widthwise aligning device places the sheet at the appropriate position in the width direction, the conveying force applied to the sheet by the sheet transfer device is increased.

In order to adjust the conveying force of the sheet transfer device, the sheet transfer device comprises a sheet feeding rotating member that engages with the sheet on the tray, wherein the sheet feeding rotating member is made such that a peripheral speed at which the sheet feeding rotating member contacts the sheet on the tray is varied, or a pressure contact force under which the sheet feeding rotating member contacts the sheet is varied. The sheet transfer device may comprise a sheet feeding rotating member that engages with the sheet on the tray and a brake member that applies a braking action to the sheet so that the braking action of the braking member enables adjustment of the conveying force applied to the sheet by the sheet feeding rotating member.

BRIEF DESCRIPTION OF THE DRAWINGS

FIG. 3(*b*) is a diagram illustrating an essential part of the apparatus in FIG. 2, showing the configuration of widthwise aligning device;

FIGS. 5(*b*) and 5(*c*) are diagrams illustrating the sheet aligning operation state, showing an operation of the sheet transfer device;

FIG. 6(*b*) is a diagram illustrating the sheet aligning operation state, showing an operation of the sheet transfer device;

FIG. 7(*b*) is a diagram illustrating the sheet aligning operation state, showing an operation of the sheet transfer device; and FIG. 7(*c*) is a diagram illustrating the sheet aligning operation state, specifically showing a sheet widthwise aligning state;

FIG. 10(*b*) is a diagram illustrating the embodiment (third embodiment) different from those shown in FIGS. 3(*a*),3(*b*) and 9(*a*)-9(*c*), showing a high pressurizing state;

DETAILED DESCRIPTION OF PREFERRED EMBODIMENTS

Figure 1:
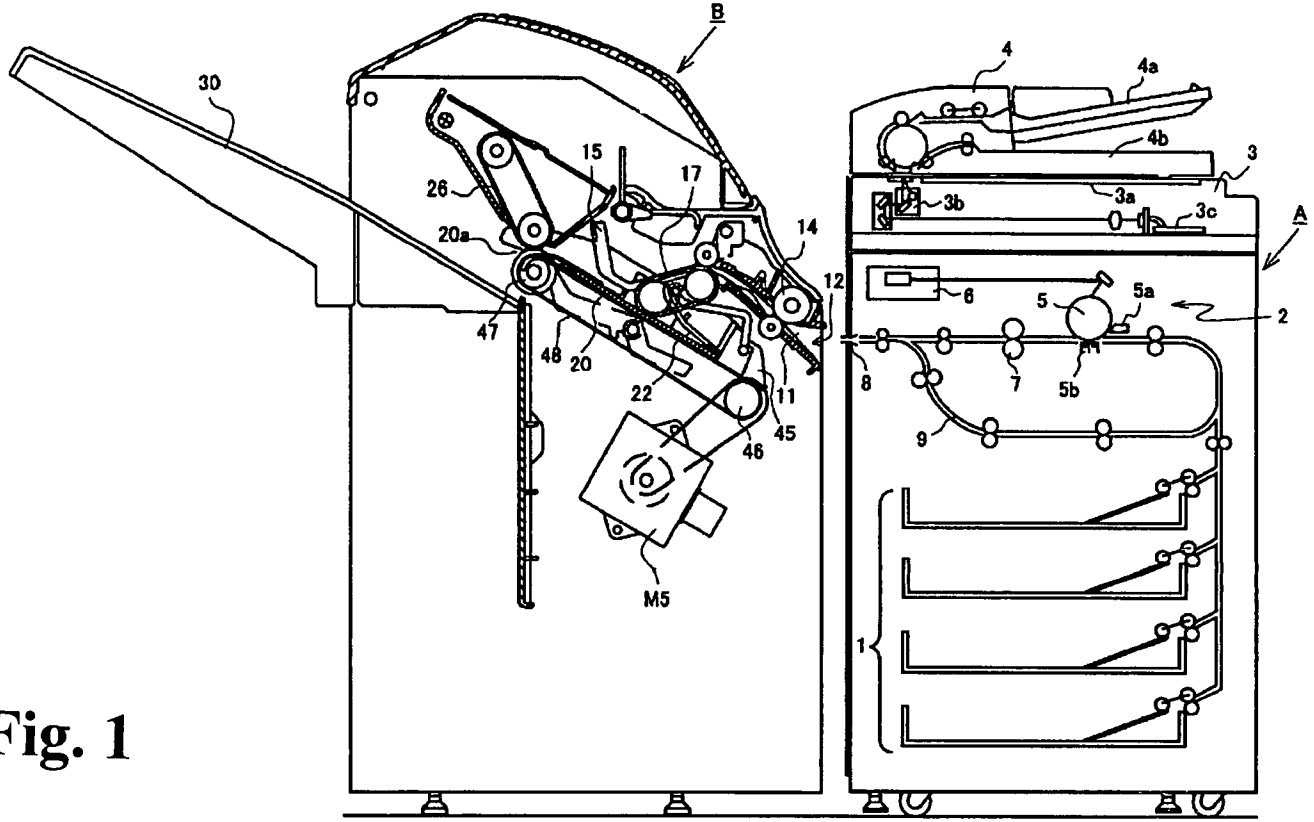
FIG. 1 is a diagram illustrating the entire configuration of a post-processing apparatus and an image forming apparatus in accordance with the present invention.
Figure 2:
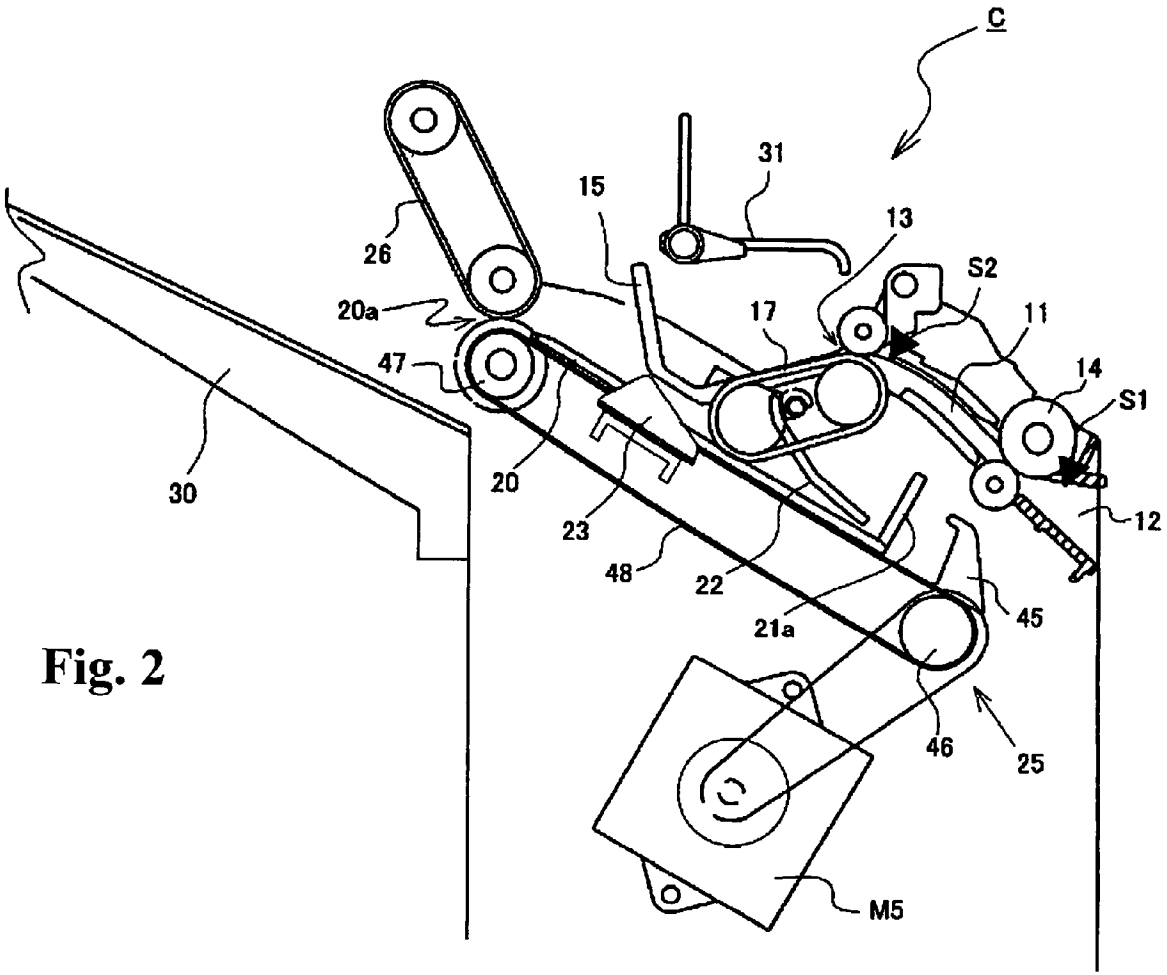
FIG. 2 is a diagram illustrating the configuration of a sheet aligning section of the post-processing apparatus in FIG. 1.

The present invention will be described below in detail on the basis of illustrated embodiments. FIG. 1 is a diagram illustrating the entire system comprising a post-processing apparatus containing a sheet aligning device and an image forming apparatus that conveys sheets to the post-processing apparatus in accordance with the present invention. FIG. 2 is a diagram illustrating an essential part of the post-processing apparatus. The "image forming system", the "post-processing apparatus", and the "sheet aligning device" will be described below in this order.

[Image Forming System]

Figure 9A:
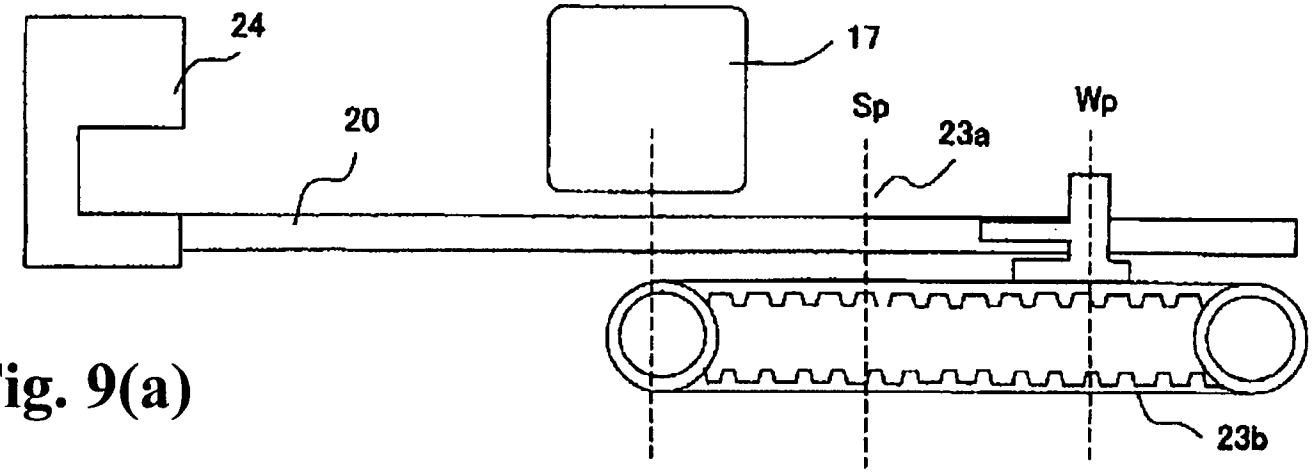
FIGS. 9(*a*) to 9(*c*) are diagrams illustrating an embodiment (second embodiment) different from the embodiment of the apparatus shown in FIGS. 3(*a*) and 3(*b*)
Figure 9B:
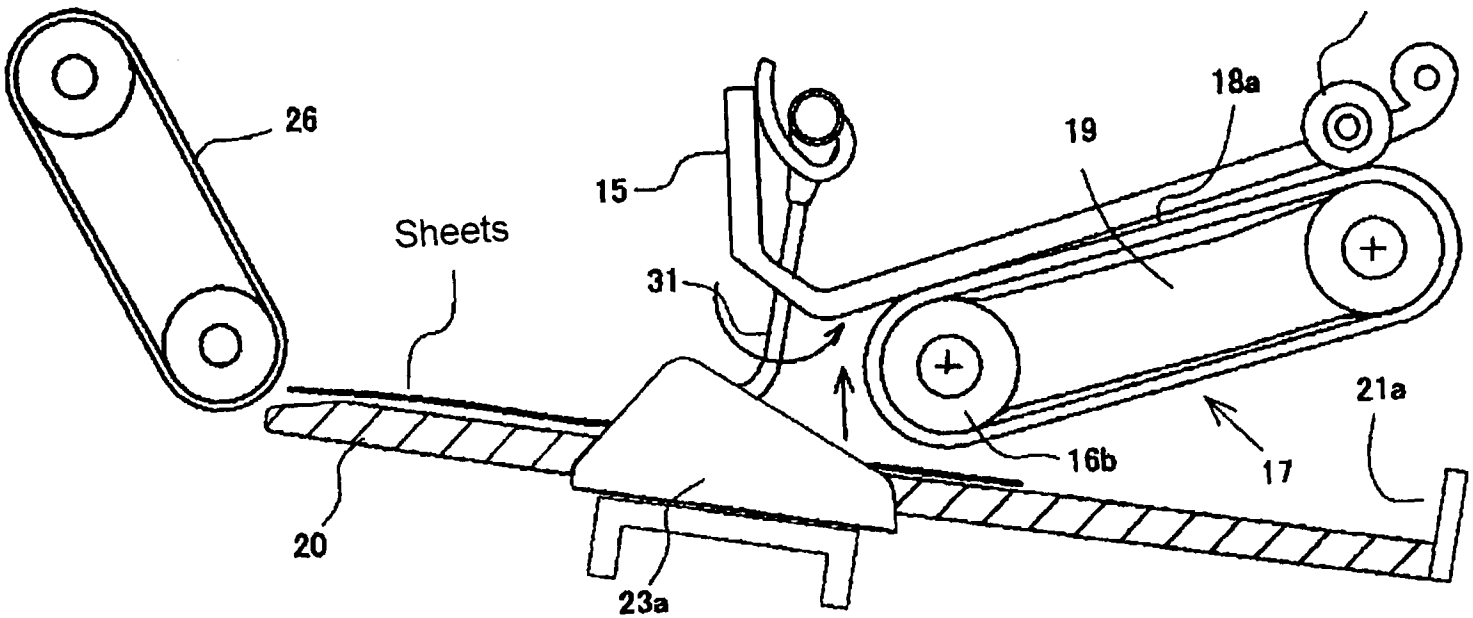
Figure 9C:
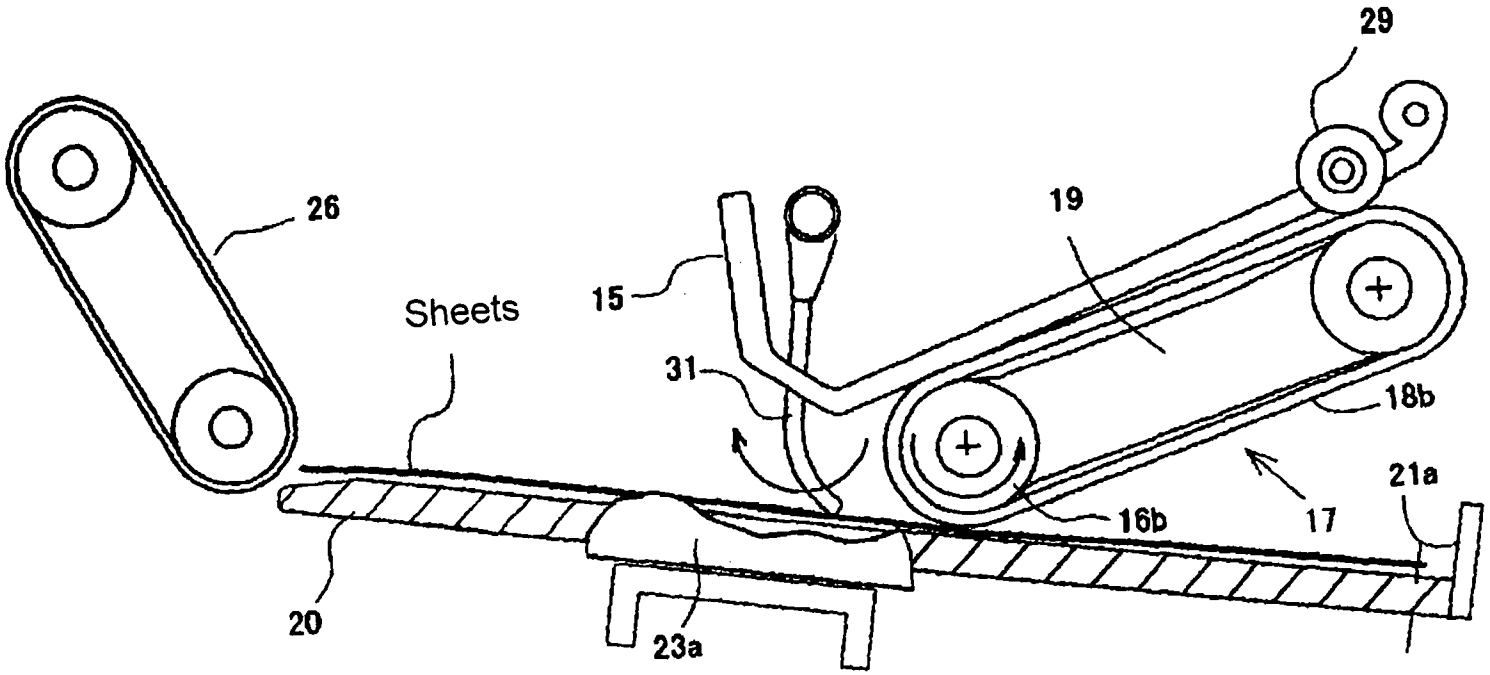

The image forming system shown in FIG. 1 is composed of an image forming apparatus A and a post-processing apparatus B having a built-in sheet aligning device C. The image forming apparatus A is composed of a sheet feeding stacker 1, an image forming section 2 that forms images on a sheets from the sheet feeding stacker 1, a scanner section 3, and a document feeding section 4. The image forming section 2 is composed of an electrostatic printing mechanism, an ink jet printing mechanism, an offset printing mechanism, or the like to copy and print image data optically read by the scanner section 3, on a sheet from the sheet feeding stacker 1. The illustrated image forming section 2 is an electrostatic printing mechanism having a photosensitive drum 5, and a developing member 5*a*, a charger 5*b*, and a print head 6 all of which are arranged around the periphery of the photosensitive drum 5. The print head 6 forms an electrostatic latent image on the photosensitive drum 5. The developing member 5*a* attaches toner ink to the photosensitive drum 5. The charger 5*b* then transfers and prints the image on a sheet. The toner ink transferred to the sheet is fixed by the fixer 7. Resulting sheets are sequentially discharged from a sheet discharging port 8. FIG. 9 is a circulation path along which a sheet with its front surface already printed is fed back to the photosensitive drum 5, which then forms an image on a back surface of the sheet for double side printing.

The scanner section 3 is composed of a platen 3*a* on which a document is placed, a reading carriage 3*b* that scans a document image in order of lines along the platen 3*a*, and a photoelectric converting sensor 3*c*. The document feeding section 4 is mounted above the scanner section 3 to separate and feed each of the documents set on the document tray 4*a* to the platen 3*a*. The sheet is then accommodated on a sheet discharging tray 4*b*. The apparatus also has a network printer function of transferring image data from an external image forming apparatus, for example, a computer, to the print head 6 to form an image on a sheet on the basis of the data.

[Post-Processing Apparatus]

The post-processing apparatus B in accordance with the present invention is coupled to the sheet discharging port 8 in the image forming apparatus A to sequentially receive sheets with images formed thereon to execute a "stapling process", a "jog process" and a "sheet carry-out (housing) process" on the sheets. Accordingly, the image forming system is composed of the image forming apparatus main body comprising a copier, a print function, a facsimile function, or the like and the post-processing apparatus coupled to the image forming apparatus main body.

The post-processing apparatus B comprises, as operation modes, a series of processing operations including a stapling process of arranging sheets with images formed thereon in the order of pages and stapling the sheets and a jog process of distributing and housing the set sheets before discharging the sheets. To control each of the operation modes, an operator sets, in the image forming apparatus A, a print mode, that is, the number of copies and a printing function, and a post-process mode, that is, the "stapling process", the "jog process", or the "sheet carry-out (housing) process". In accordance with relevant command signals from the image forming apparatus A, the post-processing apparatus B executes a process corresponding to the operation mode.

The post-processing apparatus B is composed of a sheet discharging path 11 that receives sheets sequentially discharged by the image forming apparatus A to take the sheets out to a downstream side, a processing tray 20 located below a sheet discharging port 13 of the sheet at a downstream path 11, and a housing stacker 30 located at a downstream side of the processing tray 20. The processing tray 20 has a built-in "sheet aligning device". The sheet discharging path 11 has a conveying roller 14 which conveys a sheet fed toward a carry-in port 12 and is composed of a pair of rollers that is in pressure contact with each other. The sheet discharging path 11 has an inlet sensor S1 that detects a leading end and a trailing end of the conveyed sheet.

Accordingly, a sheet from the image forming apparatus A is guided to the sheet discharging path 11 and then fed to the sheet discharging port 13 by the conveying roller 14. The sheet is then taken out to the sheet discharging port 13. The processing tray 20 is located below the sheet discharging port 13 so as to form a step. The sheet is temporarily placed and supported on the processing tray 20 and subjected to the post-process in this state. The processing tray 20 has a built-in mechanism corresponding to the function of the post-process executed on the sheet. The illustrated processing tray 20 comprises a "stapling function", a "jog function", and a "sheet carry-out function" of carrying out the sheet out of the sheet discharging port 13 to the housing stacker 30, located downstream of the processing tray 20.

The "stapling function" involves stacking and stapling a series of sheets carried out of the image forming apparatus A on the processing tray 20 in the order of pages, stapling the sheets, and carrying out the resulting sheet bundle to the housing stacker 30. The "jog function" involves distributing, housing, and setting the series of sheets carried out of the image forming apparatus A, in the housing stacker 30. The processing tray 20 thus comprises a jog shift mechanism that shifts the sheets by a predetermined amount in a direction orthogonal to a conveying direction. The function of the illustrated jog shift mechanism is provided by a widthwise aligning device 23. The "sheet carry-cut function" involves sequentially carrying out the series of sheets from the image forming apparatus A onto the housing stacker 30 without post-processing the sheets on the processing tray 20. Thus, the processing tray 20 has a forward and backward rotating roller device 26.

Figure 3A:
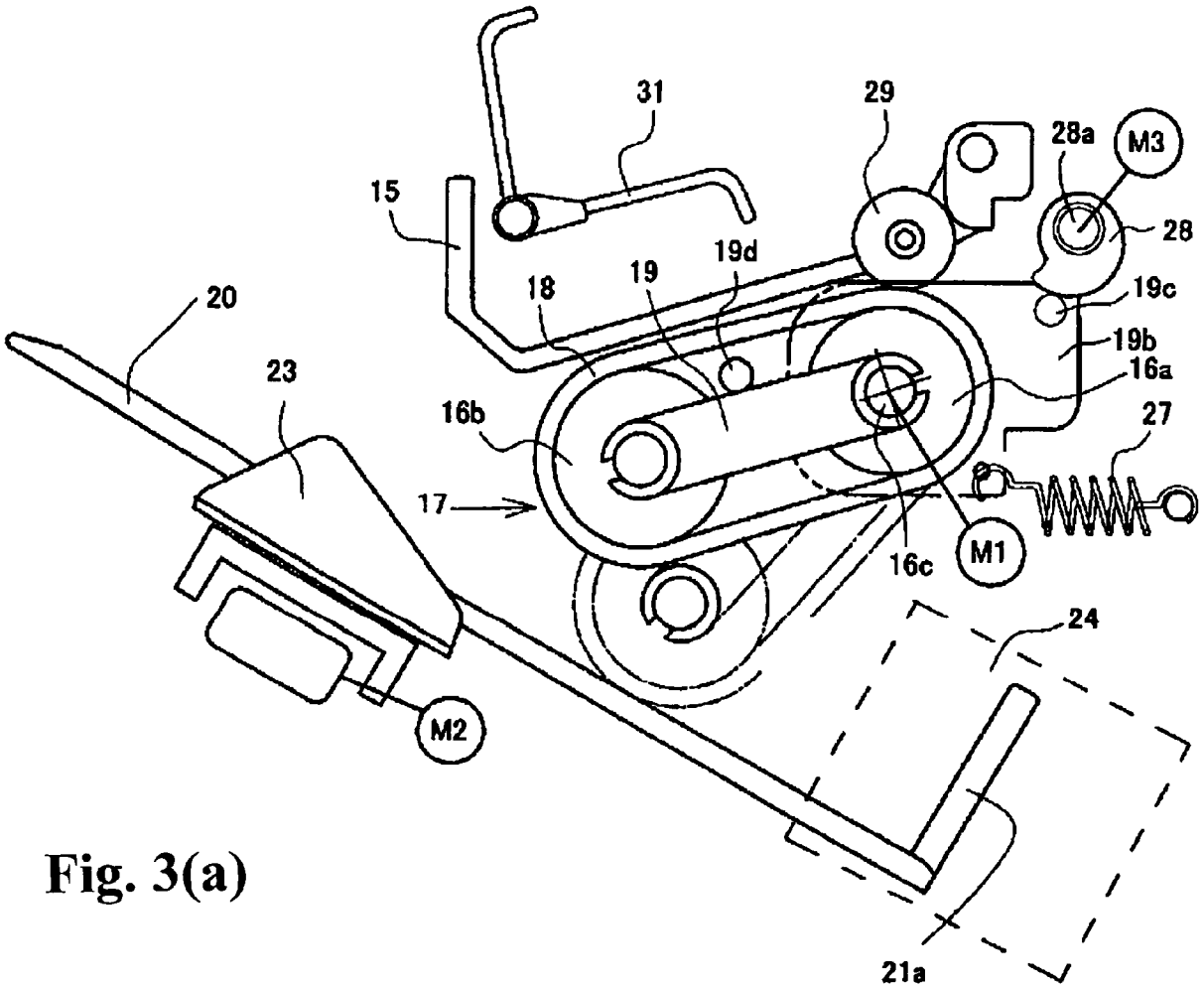
FIG. 3(*a*) is a diagram illustrating an essential part of the apparatus in FIG. 2, showing the configuration of a sheet feeding rotating member (sheet transfer device)
Figure 3B:
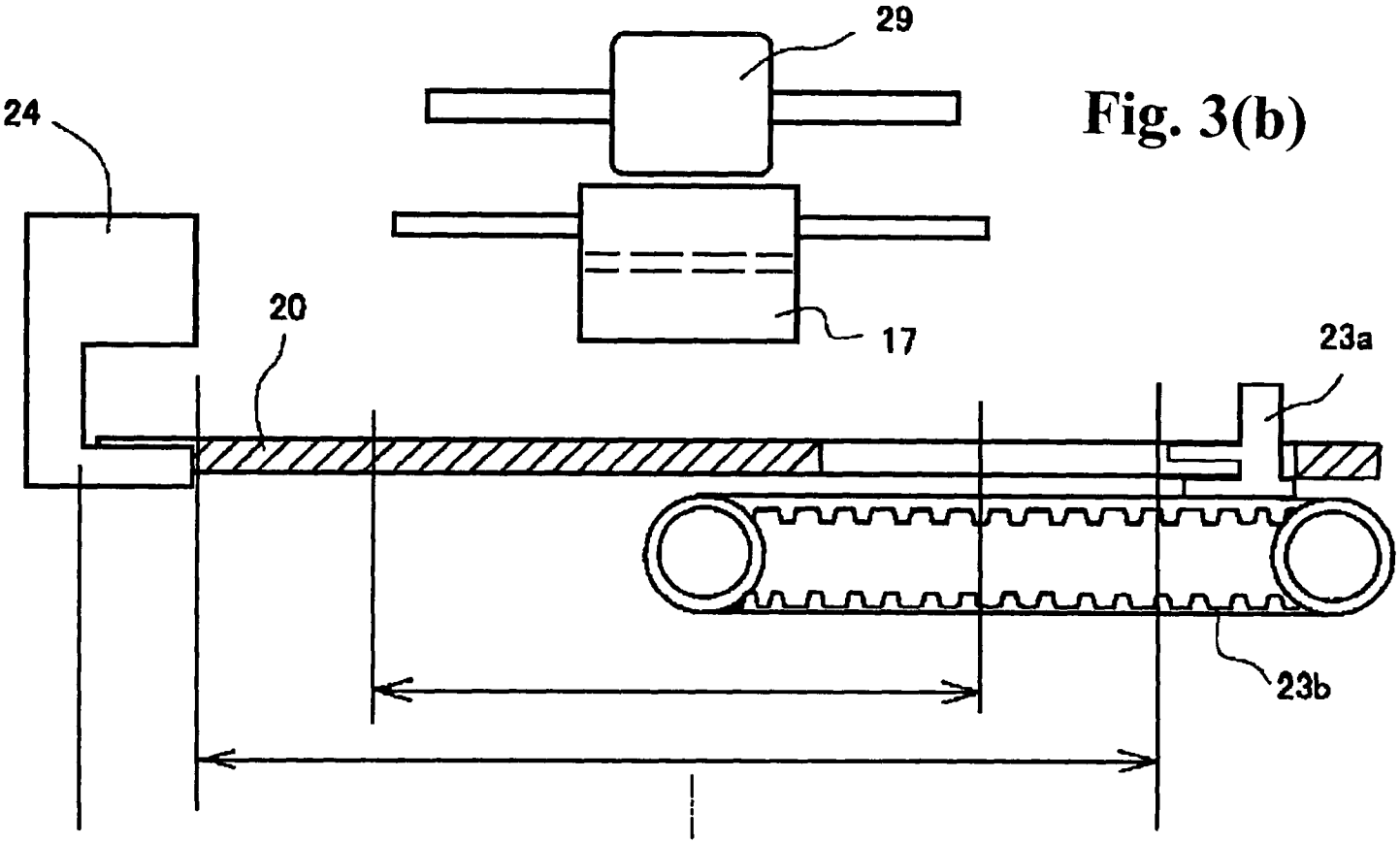
Figure 7A:
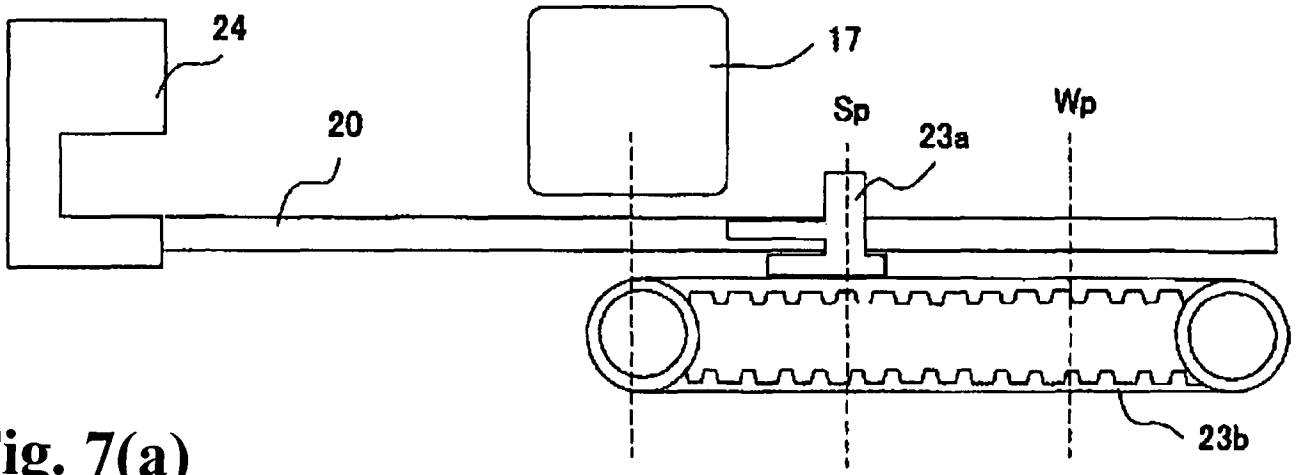
FIG. 7(*a*) is a diagram illustrating the sheet aligning operation state, showing an operation of the widthwise aligning device.
Figure 7B:
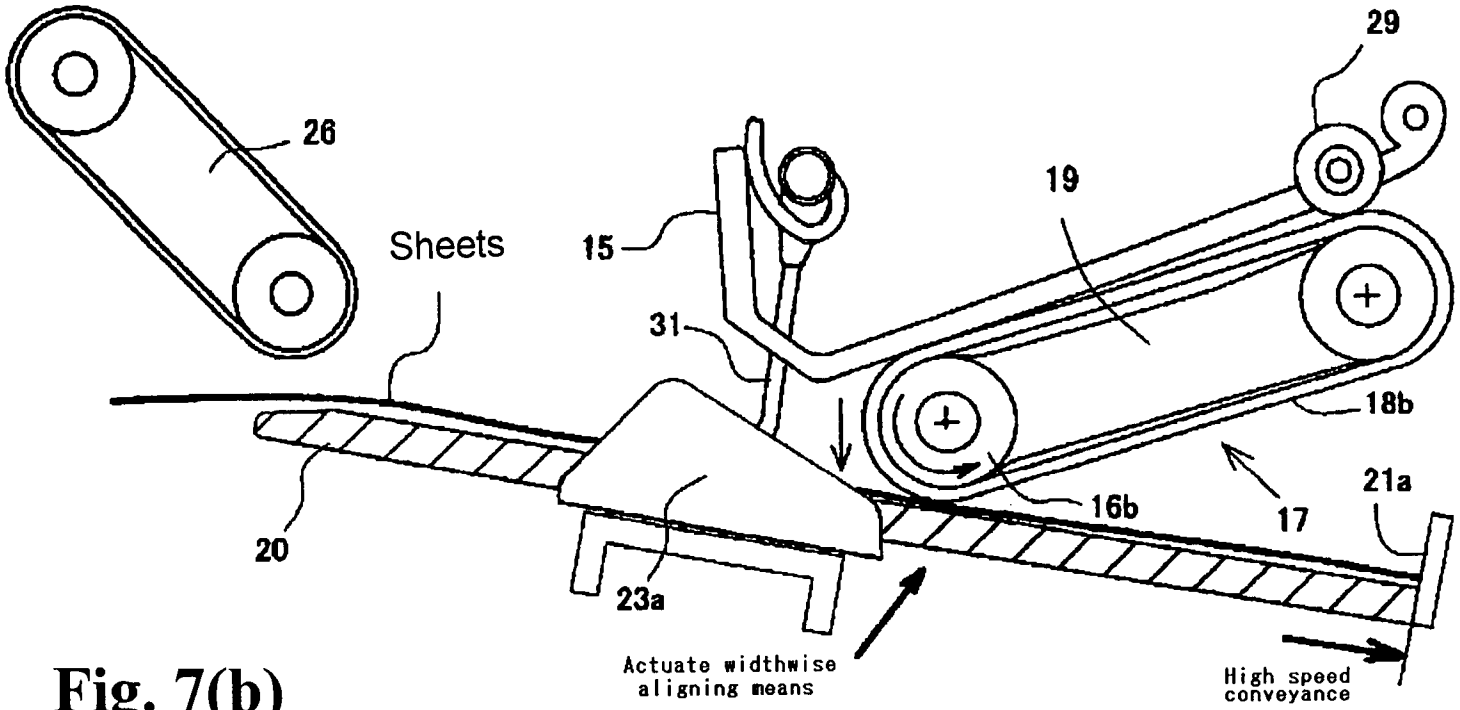
Figure 7C:
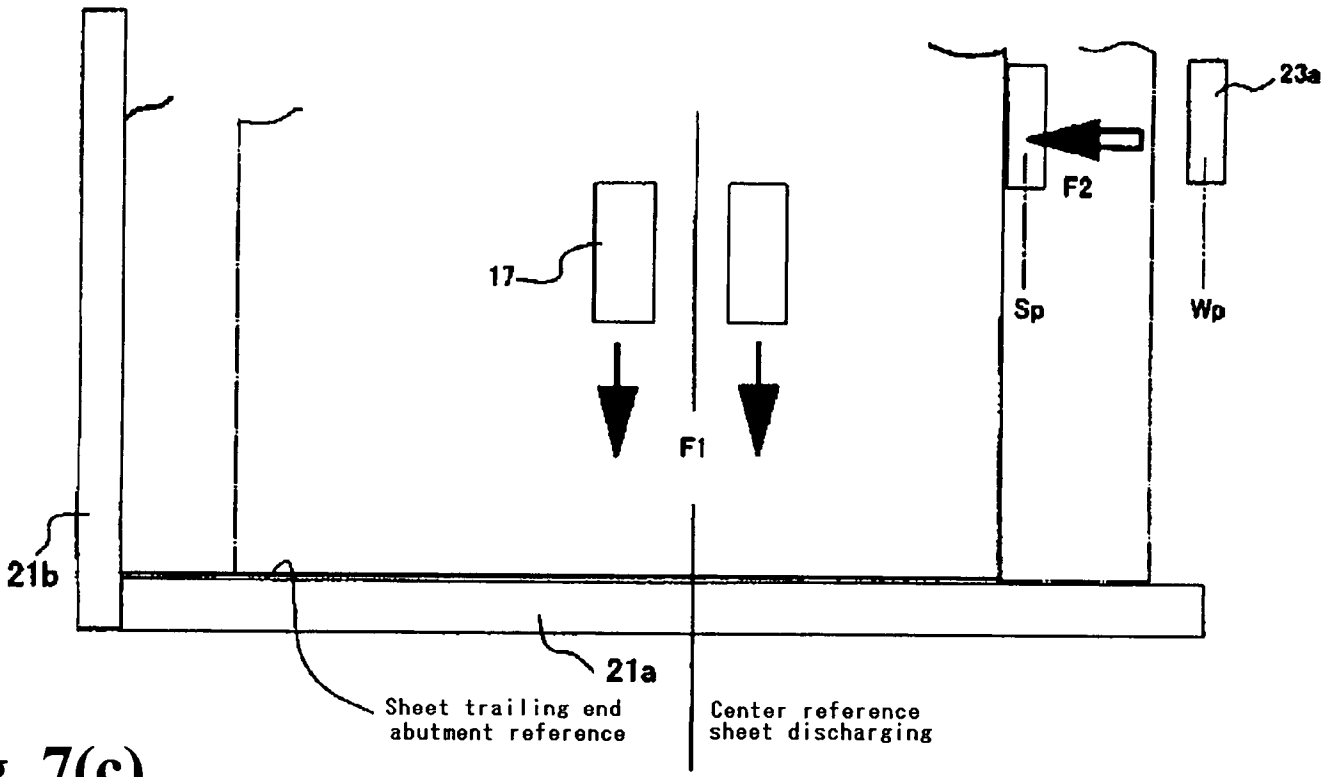

The processing tray 20 has a staple device 24 (post-processing device; shown in FIG. 3(*b*)), and a sheet end regulating member 21*a* and a side regulating member 21*b* which places the sheets at a post-processing position for alignment (shown in FIG. 7(*c*)). The sheet end regulating member 21*a* projects upward from the processing tray 20 so that the conveying-direction leading or trailing end of a sheet is abutted against the sheet end regulating member 21*a* for regulation. The side regulating member 21*b* constitutes an abutment reference, which is used when a sheet carried out onto the processing tray 20 using a center reference is moved to a processing position with the staple device (post-processing device) 24 for widthwise alignment.

The processing tray 20 has a sheet feeding rotating member 17 that guides a sheet from the sheet discharging port 13 onto the tray, the forward and backward rotating roller device 26 that carries the sheet on the processing tray 20 downstream and then switches back the sheet so that the sheet travels upstream, a sheet transfer device (the function of the sheet transfer device is provided by the sheet feeding rotating member 17) for transferring the sheet on the processing tray 20 toward the sheet end regulating member 21*a*, and a widthwise aligning device 23 that transfers the sheet on the processing tray 20 toward the side regulating member 21*b*.

According to the present invention, the sheet transfer device is composed of a rotating member such as a roller or a belt (hereinafter representatively referred to as the "sheet feeding rotating member 17") which engages with the sheet on the tray to convey the sheet on the processing tray 20 toward the sheet end regulating member 21*a*. The present invention is not limited to a belt on which the sheet from the discharging port 13 is transferred onto the processing tray 20 as shown in the figure. Any of various configurations can be adopted.

The sheet feeding rotating member (sheet transfer device; this also applies to the description below) 17 is composed of a pair of pulleys 16*a* and 16*b* and a caterpillar belt 18 extending between the pulleys 16*a* and 16*b*. The sheet feeding rotating member 17 is located between the sheet discharging port 13 and the processing tray 20 along the sheet conveying direction. The sheet feeding rotating member 17 is configured so that the upper half of the belt (loose side) 18*a* carries a sheet from the sheet discharging port 13 onto the processing tray 20, while the lower half of the belt (tensile side) 18*b* transfers the sheet on the processing tray 20 toward the sheet end regulating member 21*a*. Thus, the pulley 16*a* (hereinafter referred to as the fixed pulley), positioned at the sheet discharging port 13, is fixed to an apparatus frame. The pulley 16*a* has a rotating shaft 16*c* to which a driving motor M1 is coupled, so as to rotate counterclockwise in the figures.

The other pulley (movable pulley) 16*b* is supported by a swinging arm member 19 borne by the rotating shaft 16*c* of the fixed pulley 16*a*. The caterpillar belt 18 (hereinafter simply referred to as the belt) extends between the fixed pulley 16*a* and the movable pulley 16*b*. Consequently, the movable pulley 16*b* elevates and descends integrally with the belt 18 in a vertical direction, installed around the movable pulley 16*b*. The swinging arm member 19 has a bias spring 27 and shift device 28.

A coupling plate 19*b* is integrated with the swinging arm member 19. The bias spring 27 extends between the coupling plate 19*b* and the bias spring 27 to keep urging the movable pulley 16*b* toward the processing tray 20. A cam pin 19*c* is provided on the coupling plate 19*b* and engages with the shift device 28, composed of an eccentric cam, to withdraw the movable pulley 16*b* to above the processing tray 20 against the force of the bias spring 27. Reference numeral 19*d* denotes a stopper. A control motor M3 is coupled to a rotating shaft 28*a* of the shift device 28, composed of an eccentric cam. Thus, when a cam surface engages with the cam pin 19*c*, the movable pulley 16*b* is placed at an inoperative position above the processing tray 20. When the cam pin 19*c* leaves the cam surface, the movable pulley 16*b* moves, under the force of the bias spring 27, to an operative position where the pulley 16*b* comes into pressure contact with the uppermost sheet on the processing tray 20. The shift device 28 is not limited to the eccentric cam. The shift device 28 may have any of various structures provided that the shift device 28 constitutes a mechanism that elevates and descends the movable pulley 16*b* between the operative position, where the pulley 16*b* comes into pressure contact with the sheet on the processing tray 20, and the inoperative position, where the pulley 16*b* is withdrawn from the sheet.

A pinch roller 29 is located in pressure contact with the sheet feeding rotating member 17 and closer to the sheet discharging port. A guide plate 15 is located over the belt upper half portion 18*a* so as to be able to swing freely. Reference numeral 31 denotes a sheet scrubbing paddle composed of a flexible blade member. A forward and backward rotating motor M6 is coupled to the paddle 31. Forward and backward rotating roller device 26 is located at the processing tray 20 to feed a sheet downstream which has been carried onto the processing tray 20. The sheet is then supported between the housing stacker 30, described below, and the processing tray 20 like a bridge. That is, the sheet from the sheet discharging port 13 has its leading end supported by the housing stacker 30 and its trailing end supported by the processing tray 20. Thus, the forward and backward rotating roller device 26 is supported so as to swing freely in the vertical direction with respect to the processing tray 20. The forward and backward rotating roller device 26 is coupled to a driving motor so as to rotate forward and backward.

The sheet feeding rotating member 17 also serves as the sheet transfer device for transferring a sheet on the processing tray 20 toward the sheet end regulating member 21*a*. Thus, in the illustrated apparatus, the sheet feeding rotating member 17 feeds the sheet on the processing tray 20 toward the sheet end regulating member 21*a*. Accordingly, the apparatus has a sheet pressing device 22 for preventing the leading end of the sheet from being deflected owing to curling or the like. The sheet pressing device 22 is an elastic pressing plate (weight member) that abuts against the uppermost sheet on the processing tray 20. The sheet pressing device 22 hangs from above the processing tray 20 so as to swing freely.

The post-processing device (shown in FIGS. 3(*a*) and 3(*b*)) is located on the thus configured processing tray 20. The illustrated post-processing device constitutes the staple device 24. A sheet is discharged from the sheet discharging port 13 using a center reference and carried onto the processing tray 20 by the sheet feeding rotating member 17 and the forward and backward rotating roller device 26. Once the sheet trailing end advances onto the processing tray 20, the forward and backward rotating device 26 is reversely rotated to switch back the sheet, which then advances onto the belt lower half portion 18*b* of the sheet feeding rotating member 17. The sheet is then transferred by the sheet transfer device, composed of the sheet feeding rotating member 17, so that the trailing end of the sheet abuts against the sheet end regulating member 21*a* for regulation. The widthwise aligning device 23 is provided on the processing tray 20 to set the position of the sheet transferred using the center reference, in the orthogonal direction, to place the sheet at the post-processing position for widthwise alignment.

The widthwise aligning device 23 is composed of a plate-like member provided on the processing tray 20 so as to be movable in the sheet conveying orthogonal direction. The widthwise aligning device 23 comprises, for example, a mechanism shown in FIG. 3(*b*). A belt 23*b* is located on a back surface of the processing tray 20 so as to be movable in the conveying orthogonal direction. The belt 23*b* is reciprocated at a predetermined stroke by a driving motor M2. An aligning plate 23*a* engaging with a side edge of the sheet is fixed to the belt 23*b*. Consequently, the aligning plate 23 projects from the processing tray 20 to move in the sheet conveying orthogonal direction to move the sheet in the width direction by a predetermined amount.

The sheet feeding rotating member 17 and the guide plate 15 are arranged in a pair with an appropriate distance between the sheet feeding rotating member 17 and the guide plate 15 in the sheet width direction (the conveying orthogonal direction; this also applies to the description below). A sheet push-out device 25 is also located on the processing tray 20 as described below in order to transfer the post-processed sheet to the downstream housing stacker 30. A guide groove (not shown) is formed in the center of the Processing tray 20 in the sheet width direction so that a push-cut pawl 45 moves through the guide groove. The push-out pawl 45 transfers the sheet located on the downstream sheet end regulating member 21*a*, along the guide groove to an upstream eject port 20*a*. Thus, a belt member 48 extends between a pair of pulleys 46 and 47 provided below the processing tray 20, and the push-out pawl 45 is integrally fixed to the belt member 48. A sheet push-out pawl driving motor 45 is coupled to the pulley 46. Consequently, the sheet push-out pawl driving motor M5 moves the push-out pawl 45 around the periphery of the processing tray 20 so that the push-out pawl 45 travels longitudinally. Similarly to the sheet push-out pawl 45, the forward and backward rotating device 26 configured as described above is provided at the eject port 20*a*.

[Housing Stacker]

Figure 4:
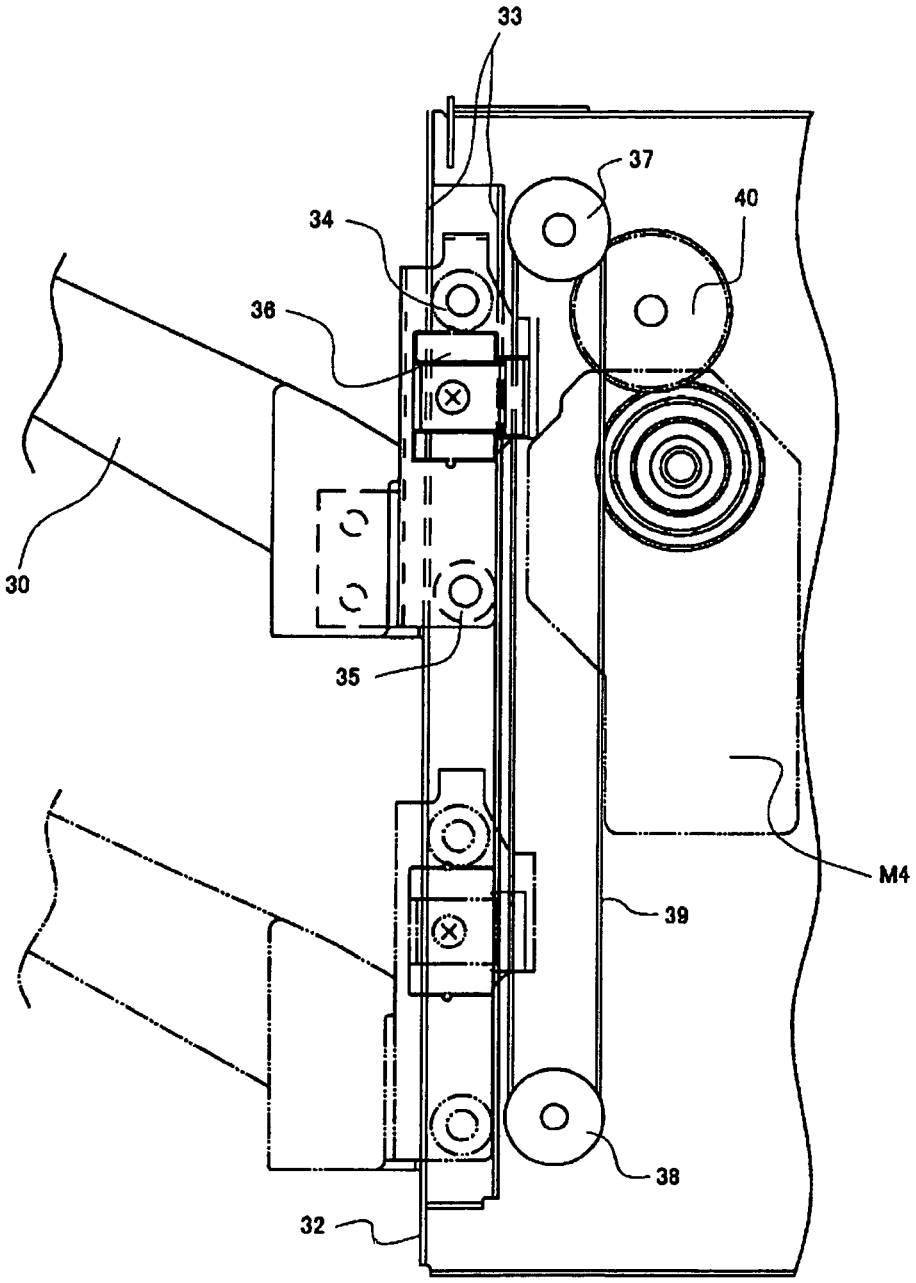
FIG. 4 is a diagram showing the structure of a housing stacker.

Description will be given of the structure of the housing stacker 30, located downstream of the processing tray 20, described above. As shown in FIG. 4, the housing stacker 30 is attached to the apparatus frame 32 so as to elevate and descend freely. The housing stacker 30 is controllably elevated and descended so that the uppermost surface of stacked sheets is positioned at the eject port 20*a*. The apparatus frame 32 has a guide rail 33 extending along a sheet stacking direction. Rollers 34 and 35 fitted in the guide rail 33 are attached to a fixing member 36 of the housing stacker 30.

Consequently, the housing stacker 30 is supported so as to be freely elevated and descended along the guide rail 33 by the pair of rollers 34 and 35, integrated with the housing stacker 30. The apparatus frame 32 has a vertical pair of pulleys 37 and 38 and an elevating and lowering belt 39 extending between the pulleys 37 and 38. The fixing member 36 is fixed to the elevating and descending belt 39. An elevating and descending motor M is coupled to one of the pulleys 37 and 38 via a transmission gear 40. The elevating and descending motor M4 drivingly elevates and descends the housing stacker 30 in the vertical direction of the figure.

On the other hand, an upper limit sensor (not shown) is mounted above the housing stacker 30. The elevating and descending motor M4 gradually descends the housing stacker 30 in accordance with the amount of stacked sheets so that the uppermost sheet on the housing stacker 30 lies at the position of the upper limit sensor. After the sheets on the housing stacker 30 are removed, the elevating and descending motor M4 elevates the top surface of the tray to the position of the upper limit sensor. According to the present embodiment, the housing stacker 30 may be fixedly attached to the apparatus frame 32 so as not to elevate or descend as shown in the figure.

In the present invention, a sheet from the sheet discharging port 13 is placed on the processing tray 20 and along the sheet end regulating member 21*a* and the side regulating member 21*b* as described below. The sheet transfer device (sheet feeding rotating member) 17 transfers the sheet on the processing tray 20 toward the sheet end regulating device (hereinafter referred to as the "sheet end regulating member") 21*a*. Further, the widthwise aligning device 23, located on the processing tray 20, transfers the sheet in the conveying orthogonal direction. The driving motors M1 and M2 are coupled to the sheet feeding rotating member 17 and the widthwise aligning device 23. The sheet feeding rotating member 17 has the shift device 28, composed of the eccentric cam and the control motor M3 thereby to move the sheet feeding rotating member 17 between an operative position where the member 17 abuts against the sheet on the processing tray 20 and an inoperative position where the member 17 leaves the sheet. The driving motors M1, M2, and M3 are controlled by control device 50 composed of a control CPU or the like.

The sheet carried onto the processing tray 20 is then placed at a predetermined position for alignment. The alignment involves, if a post-process such as stapling is executed on the sheet, placing the conveying-direction leading or trailing end and conveying-orthogonal-direction side end of the sheet at respective predetermined positions so as to meet processing criteria for the post-processing device 24. Further, to subject the sheet to a jog process, the sheet on the processing tray 20 is displaced in the conveying orthogonal direction by a predetermined amount (offset).

In the present invention, sheet alignment is performed as follows. (1) The sheet end (leading or trailing end) is abutted against the sheet end regulating member 21*a*, and the sheet is then moved in the orthogonal direction, that is, the width direction. In this case, (2) when the sheet end is abutted against the sheet end regulating member 21*a*, the sheet transfer device (sheet feeding rotating member) 17 reduces the conveying force applied to the sheet. Then, (3) when the widthwise aligning device 23 places the sheet at the appropriate position in the width direction, the conveying force applied to the sheet by the sheet transfer device (sheet feeding rotating member) 17 is increased.

The adjustment of the conveying force of the sheet transfer device (sheet feeding rotating member) 17 is achieved by (1) adjusting the peripheral speed of the sheet feeding rotating member 17 (first embodiment described below), (2) allowing the brake device (paddle) 31 to brake the sheet feeding rotating member 17 to adjust the conveying force of the sheet feeding rotating member 17 (second embodiment described below), or (3) adjusting the magnitude of the engaging force between the sheet feeding rotating member 17 and the sheet (third embodiment described below). These operations will be described below.

[Carrying a Sheet onto the Processing Tray]

Figure 5A:
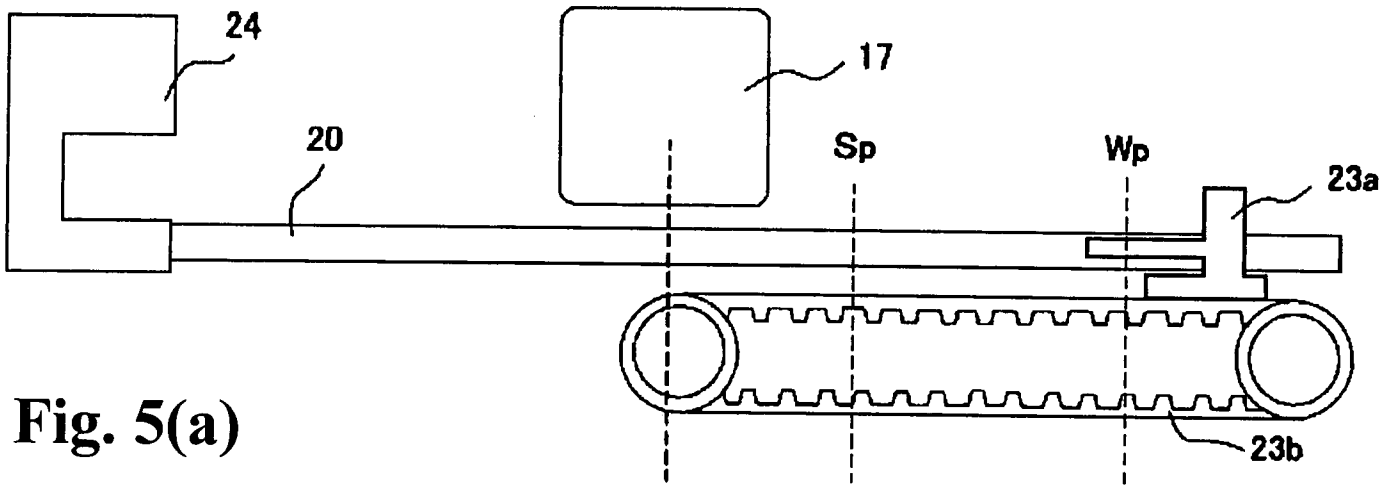
FIG. 5(*a*) is a diagram illustrating a sheet aligning operation state, showing an operation of the widthwise aligning device.
Figure 5B:
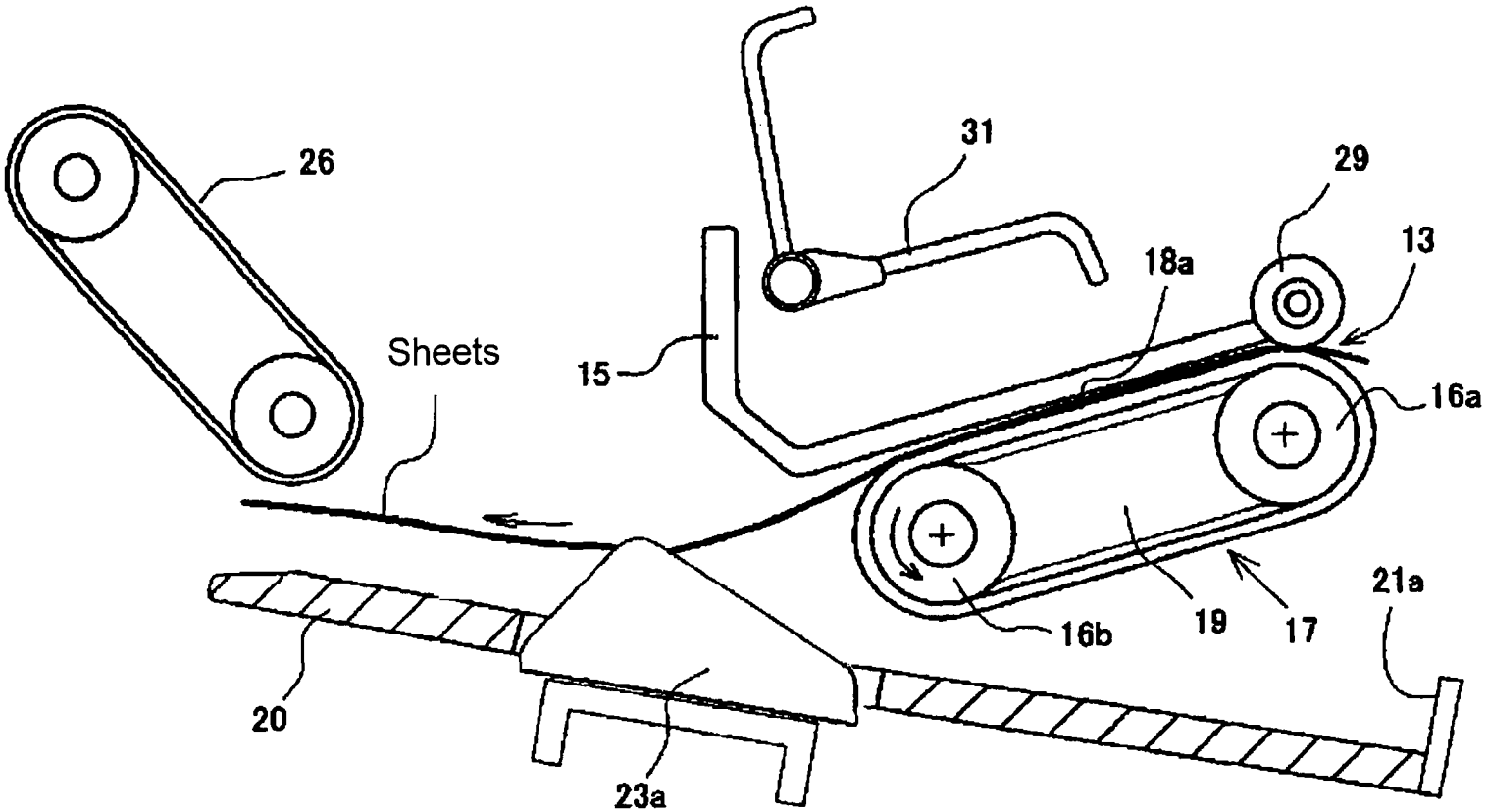
Figure 5C:
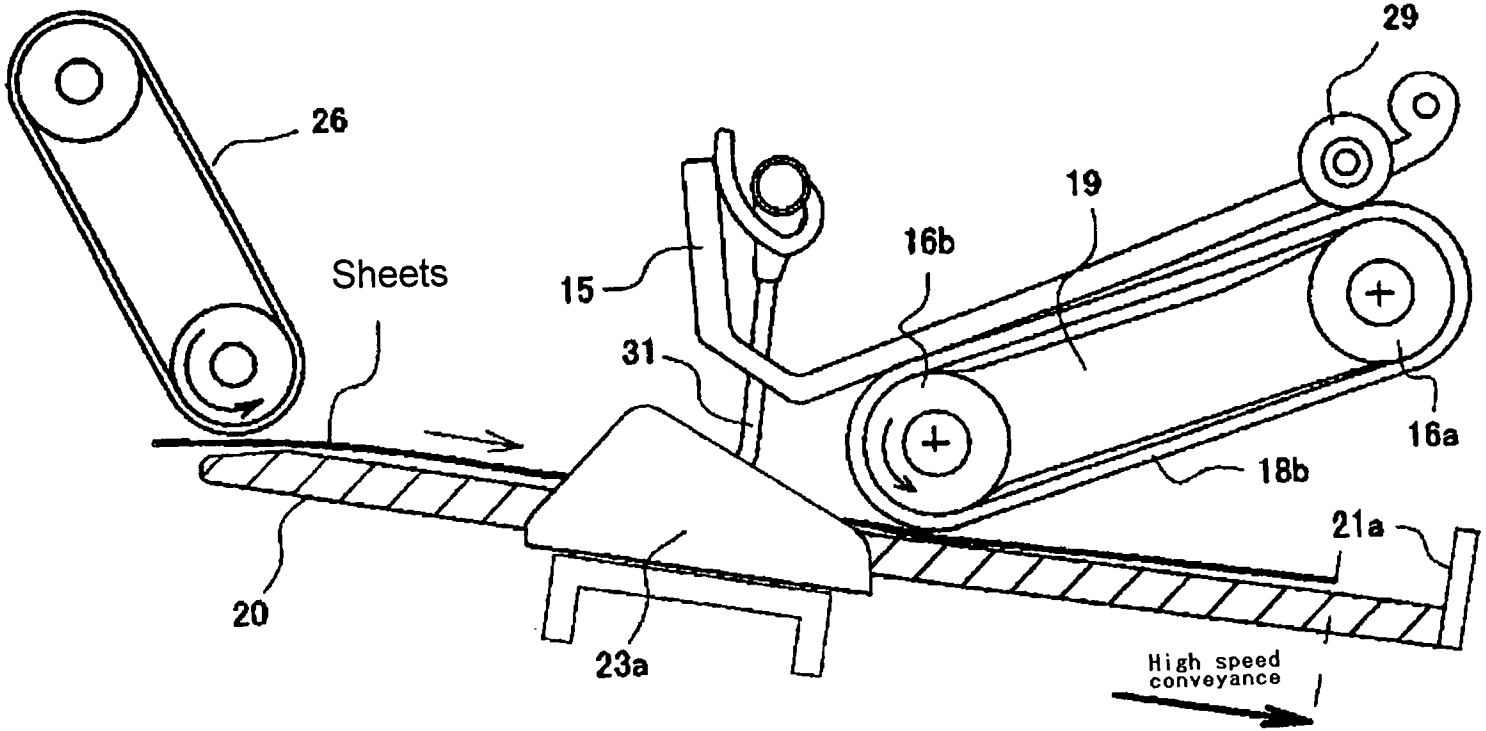
Figure 8:
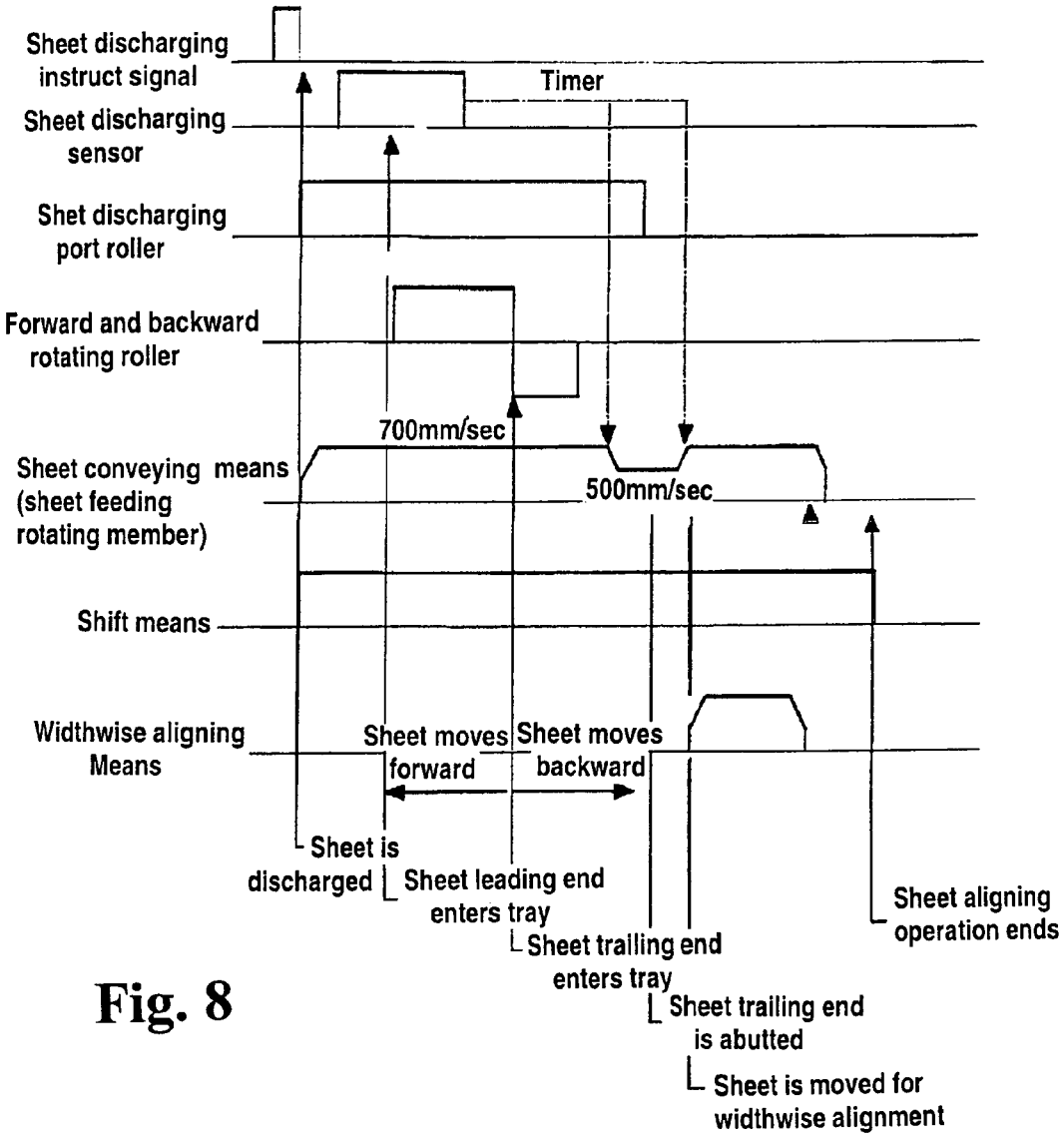
FIG. 8 is a timing chart for a sheet aligning operation in the apparatuses in FIG. 3.

According to the first to third embodiments described above, upon receiving a sheet discharge instruction signal as shown in FIG. 8, a control device 60 moves the sheet feeding rotating member 17 to the inoperative position, where the member 17 leaves the sheet on the processing tray 20, and moves the forward and backward rotating roller device 26 to a standby position where the device 26 leaves the sheet on the processing tray 20, as shown in FIG. 5(*b*). At the same time, the control device 60 rotates the driving motors M1 and M2 for the sheet feeding rotating member 17 and the forward and backward rotating roller device 26 in a sheet discharging direction. At this time, the control device 60 holds the widthwise aligning device 23 at a standby position Wp located away from the uppermost sheet on the processing tray 20 as shown in FIG. 5(*a*). In this state, a sheet from the conveying roller 14 is fed to the sheet discharging port 13 and nipped between the pinch roller 29 and the upper half portion 18*a* of the belt. The sheet is then transferred in a direction shown by an arrow in the figure.

At this time, the guide plate 15 guides the sheet to above the processing tray 20. A sheet discharging sensor S2 senses the sheet leading end. Then, after an expected time when the sheet leading end reaches the forward and backward rotating roller device 26, the control device 60 moves the forward and backward rotating roller device 26 from the withdrawal position to the operative position, where the device 26 abuts against the sheet carried onto the processing tray 20. The roller is thus rotated clockwise. Then, the sheet is drawn from the processing tray 20 to the housing stacker 30 by the forward and backward rotating roller device 26 and the sheet feeding rotating member 17. The sheet is thus supported by the processing tray 20 and the housing stacker 30 like a bridge.

[Reverse Transfer (Switchback) of the Sheet]

Then, after an expected time when the sheet discharging sensor S2 detects the sheet trailing end carried onto the processing tray 20, the control device 60 reversely rotates the forward and backward rotating roller device 26 counterclockwise and rotates the paddle 31 counterclockwise. At the same time, the control device 60 descends the sheet feeding rotating member 17 to the operative position. The movement of the sheet feeding rotating member 17 is achieved by drivingly rotating the control motor M3 to separate the eccentric cam (shift device) 28 from the cam pin 19*c*. Then, the swinging arm member 19 of the sheet feeding rotating member 17 is subjected to the action of the bias spring 27 to move the sheet feeding rotating member 17 to the operative position, where the member 17 abuts against the uppermost sheet on the processing tray 20 as shown in FIG. 5(*c*). In this case, the sheet feeding rotating member 17 is rotated at a preset high rotation speed to exert a strong conveying force in order to reliably transfer the sheet at the high speed (sheet high-speed transfer).

The widthwise aligning device 23 is held at the standby position Wp, shown in FIG. 5(*a*). Accordingly, the sheet carried onto the processing tray is transferred in the reverse direction so that the trailing end of the sheet moves toward the sheet end regulating member 21*a* (high-speed transfer). The paddle 31 guides the sheet so that the sheet trailing end advances between the lower half portion 18*b* of the belt of the sheet feeding rotating member 17 and the processing tray 20. Then, after an expected time when the sheet trailing end is delivered to the sheet feeding rotating member 17 at the operative position, the control device 60 moves the forward and backward rotating roller device 26 to the withdrawal position above the processing tray 20. The sheet is then transferred at a high speed by the sheet feeding rotating member 17 so that the sheet trailing end moves toward the sheet end regulating member 21*a* as shown in FIG. 5(*c*).

Description of the First Embodiment

Sheet Widthwise Alignment

Figure 6A:
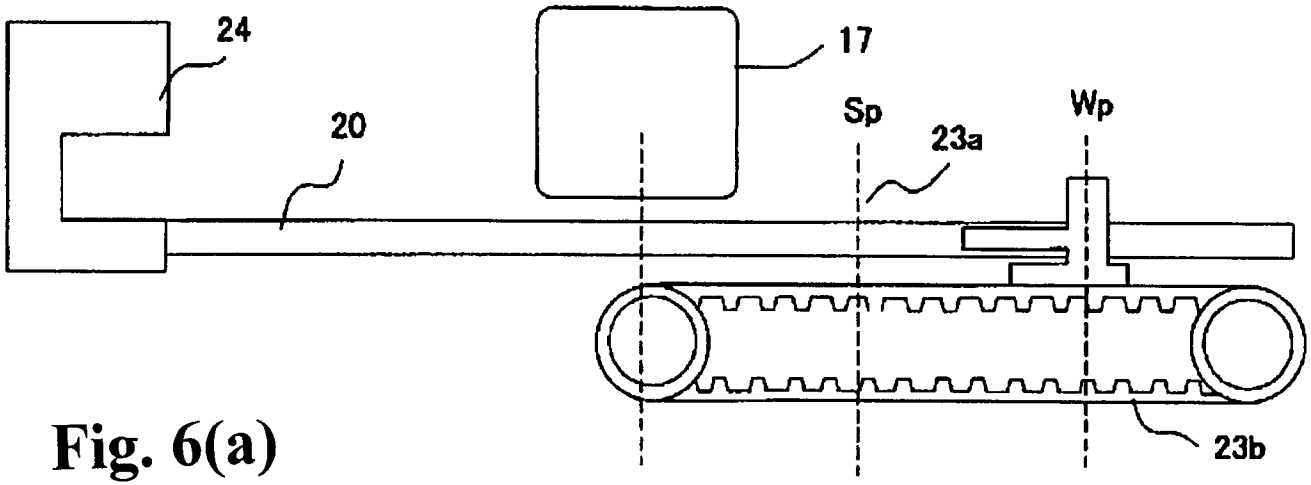
FIG. 6(*a*) is a diagram illustrating the sheet aligning operation state, showing an operation of the widthwise aligning device.
Figure 6B:
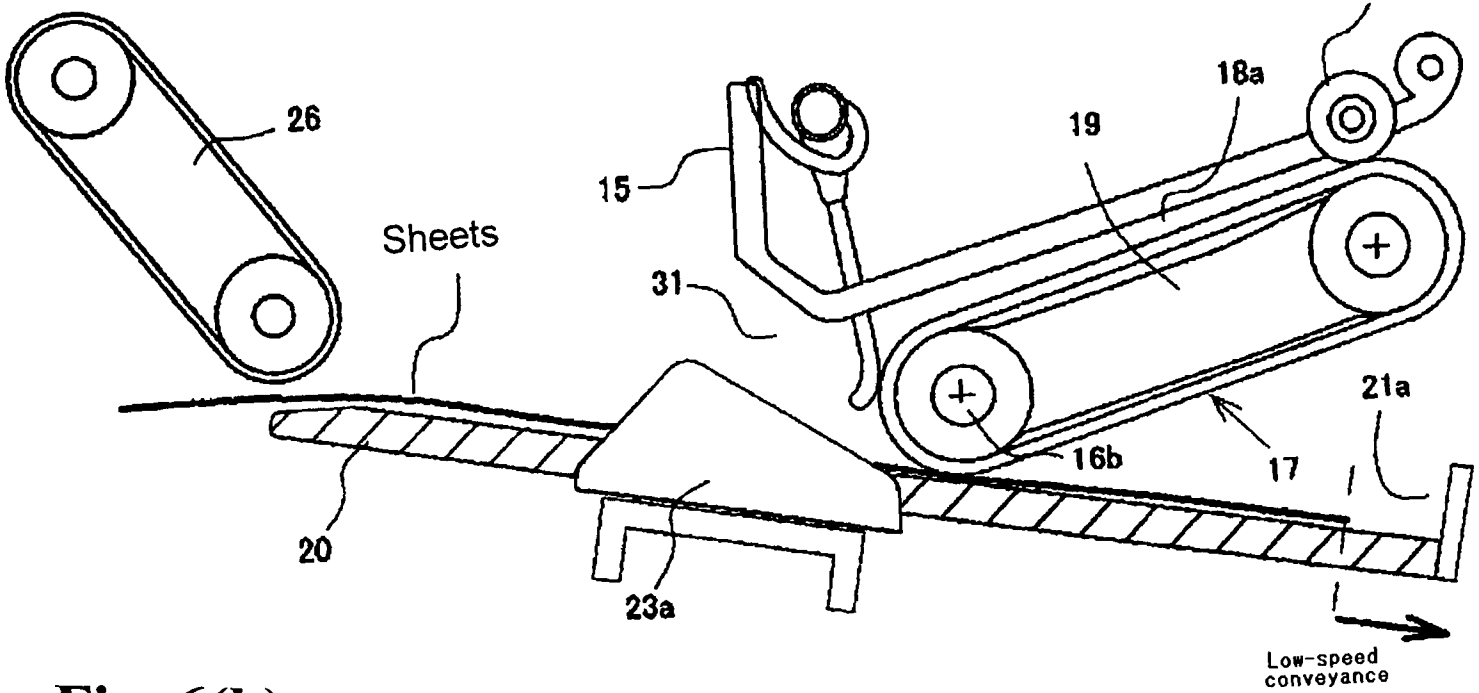

The first embodiment will be described below. The control device 60 switches the sheet feeding rotating member 17 from a high speed to a low speed immediately before (expected time) the sheet trailing end abuts against the sheet end regulating member 21*a* (as shown in FIG. 6(*b*)). For the speed reduction, for example, the sheet feeding rotating member 17 is rotated at a high speed of 700 mm/sec, and immediately before the sheet end reaches the sheet end regulating member 21*a*, the speed is reduced to 500 mm/sec, as shown in FIG. 8. The higher rotation speed is set, taking into account the processing time required to carry the sheet onto the processing tray and then move the sheet to the regulating portion. The lower rotation speed is set at a value at which the sheet end is not damaged upon abutting against the sheet end regulating member 21*a*.

Then, at a timing when the sheet trailing end reaches the regulating member 21*a*, the control device 60 actuates the driving motor M2 for the widthwise aligning device 23 to move the aligning plate 23*a* toward the center of the tray. Then, as shown in FIGS. 7(*a*) and 7(*c*), the sheet moves on the processing tray 20 in the conveying orthogonal direction toward the post-processing position or a jog position. Simultaneously with the widthwise movement of the aligning plate 23*a*, the control device 60 changes the speed of the sheet feeding rotating member 17 to a high speed (for example, 700 mm/sec). Then, as shown in FIG. 7(*c*), a conveying force F1 acts on the sheet so as to abut the sheet end (trailing end) against the sheet end regulating member 21*a*. At the same time, the widthwise aligning device 23 causes a conveying force F2 to act in the conveying orthogonal direction. The speed V1 of the sheet feeding rotating member and the speed V2 of the widthwise aligning device are set so that V1 is larger than V2 to set the conveying forces F1 and F2 so that F1 is larger than F2. Consequently, the sheet on the processing tray 20 has its trailing end moved along the sheet end regulating member 21*a* for widthwise alignment. The speed of the sheet feeding rotating member 17 during the movement is set at the optimum value (in the figure, 700 mm/sec) at which the sheet is not skewed under the conveying force F2 of the widthwise aligning device 23.

[Abutting the Sheet against the Regulating Member for Alignment]

Then, the control device 60 stops the driving motor M2 for the aligning plate 23*a*. After an expected time when the sheet trailing end is reliably aligned with the sheet end regulating member 21*a*, the control device 60 operates the shift device 28 to move the sheet feeding rotating member 17 to the withdrawal position. The above sheet aligning state will be described with reference to FIG. 7(*c*). A sheet is carried out onto the processing tray 20 using the center reference. (1) First, the sheet trailing end is transferred toward the sheet end regulating member 21*a* at a high speed by the sheet feeding rotating member 17. (2) Then, with the speed of the sheet feeding rotating member 17 reduced, the sheet trailing end abuts against the sheet end regulating member 21*a* to stop the sheet. (3) The sheet feeding rotating member 17 is returned to the high speed rotation, and the widthwise aligning device 23 moves the sheet in the orthogonal direction by the predetermined amount. The (1) high speed rotation, (2) low speed rotation, and (3) high speed rotation of the sheet transfer device (sheet feeding rotating member) 17 allow the sheet to be reliably placed in the predetermined posture without undergoing leading end bending or skewing.

Second Embodiment

A second embodiment different from the first embodiment described above will be described with reference to FIGS. 9(*a*)-9(*c*). In the first embodiment, the conveying force exerted on the sheet is adjusted by varying the speed of the sheet feeding rotating member 17 in order of the "high speed rotation", the "low speed rotation", and the "high speed rotation". However, with the speed of the sheet feeding rotating member 17 set at a fixed value, a brake device (for example, the paddle 31, described below) may be used to adjust the moving speed of the sheet. In the second embodiment, shown in FIGS. 9(*a*)-9(*c*), the paddle 31 is used as a brake device for acting on the sheet to reduce the moving speed of the sheet. The other arrangements are the same as those in FIGS. 3(*a*) and 3(*b*) and are denoted by the same reference numerals. The other arrangements will not be described below.

The driving motor M6 for the paddle 31 is composed of a forward and backward rotating motor. To move a sheet toward the sheet end regulating device 21*a*, the paddle 31 rotates counterclockwise to guide the sheet so that the sheet is caught on the sheet feeding rotating member 17 as shown in FIG. 5(*c*). Then, immediately before (expected time) the sheet trailing end reaches the sheet end regulating member 21*a*, the control device 60 reversely rotates the driving motor M clockwise as shown in FIG. 9(*b*). At this time, the control device 60 rotates the sheet feeding rotating member 17 at a high constant speed. When the sheet trailing end reaches the sheet end regulating member 21*a*, the paddle 31 acts on the sheet as a brake to reduce the moving speed of the sheet. Consequently, when the sheet trailing end abuts against the sheet end regulating member 21*a*, the conveying force applied to the sheet is reduced to allow the sheet to collide softly against the sheet end regulating member 21*a*. Subsequently, when the paddle 31 leaves the sheet, the conveying force applied to the sheet is increased by the sheet feeding rotating member 17 rotating at a high speed.

The control device 60 then actuates the driving motor M for the widthwise aligning device 23 to move the aligning plate 23*a* toward the center of the tray. Then, as shown in FIGS. 7(*a*) and 7(*c*), the sheet moves on the processing tray 2 in the conveying orthogonal direction toward the post-processing position or the jog position. The subsequent operations are the same as those shown in FIG. 3(*b*) (first embodiment) and will not be described below. As described above, the present invention allows the brake member to be used to adjust the conveying force applied to the sheet by varying the speed in order of the high speed, the low speed, and the high speed.

Third Embodiment

Now, an embodiment different from the above first and second embodiments will be described on the basis of FIGS. 10(*a*) to 11(*b*) In each of the above embodiments, the conveying force applied to the sheet is adjusted by varying the conveying speed. However, the conveying force can be adjusted by varying the pressure contact force between the sheet feeding rotating member 17 and the sheet. In the embodiment shown in FIGS. 10(*a*) and 10(*b*), the sheet feeding rotating member 17 is similar to that described above; the fixed pulley 16*a* is fixed to the apparatus frame, the movable pulley 16*b* is supported by the swinging arm member 19 borne by the rotating shaft 16*c* of the fixed pulley 16*a*, and the caterpillar belt 18 extends between the pulleys 16*a* and 16*b*. The driving motor M1 is coupled to the rotating shaft 16*c*. The sheet feeding rotating member 17 thus configured as described in the above embodiments has a weight member 41 that adjusts the pressure contact force exerted on the sheet on the processing tray 20.

The weight member 41 is borne by the rotating shaft 16*c* and is movable between a position corresponding to a weighting state where the weight is placed on the swinging arm member 19 and a position located away from the above position and corresponding to a no weight state where no weight is placed on the swinging arm member 19. The shift device 28 is coupled to the weight device 41 to allow the swinging arm member 19 to move between a withdrawal position where the swinging arm member 19 is separated from the sheet on the processing tray as shown in FIG. 10(*a*) and a pressuring position where the swinging arm member 19 is in pressure contact with the sheet on the processing tray 20 as shown in FIG. 10(*b*) (the weight of the weight member 41 is placed on the sheet) and a no weight position where the swinging arm member 19 abuts against the sheet on the processing tray 20 with no weight placed on the sheet (the own weight of the sheet feeding rotating member 17) as shown in FIG. 10(*c*).

Thus, a weight control groove 41*a* is formed in the coupling plate 19*b* so that a control pin 19*a* provided on the swinging arm member 19 is fitted in the weight control groove 41*a*. On the other hand, a link member 28*b* constituting the shift device 28 is coupled to the weight member 41 via a rotating shaft 28*a* so as to be cranked around the rotating shaft 28*a*. The control motor M3 is coupled to the rotating shaft 28*a* and rotated clockwise in the figure to allow the link member 28*b* to move the weight member 41 as shown in FIGS. 10(*a*), 10(*b*), and 11(*b*). The postural movement of the weight member 41 moves the belt transfer device 17 as follows. In the state shown in FIG. 10(*a*), the belt transfer device 17 is moved to the withdrawal position. In the state shown in FIG. 10(*b*), the belt transfer device 17 is moved to an operative position in a pressurization state (hereinafter referred to as a "heavy pressurization state") where the weight of the weight member 41 is placed on the swinging arm member 19 via the control pin 19*a*. In the state shown in FIG. 11(*a*), the belt transfer device 17 is moved to an operative position in a no weight state (hereinafter referred to as a "low pressurization state") where the belt transfer device 17 abuts against the uppermost sheet on the processing tray 20 owing to its own weight.

Figure 10A:
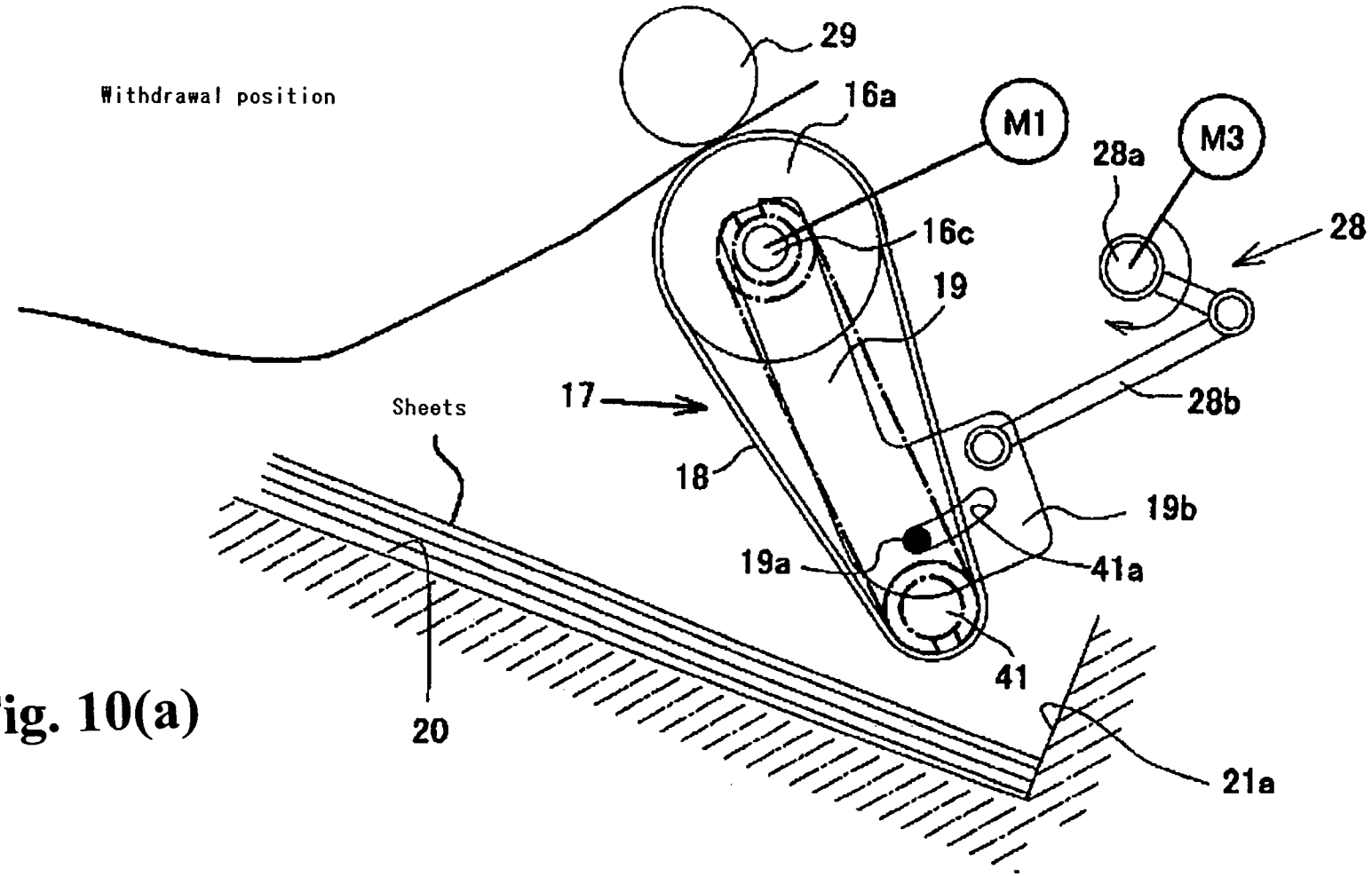
FIG. 10(*a*) is a diagram illustrating an embodiment (third embodiment) different from those shown in FIGS. 3(*a*), 3(*b*) and 9(*a*)-9(*c*), showing a state in a withdrawal position.
Figure 10B:
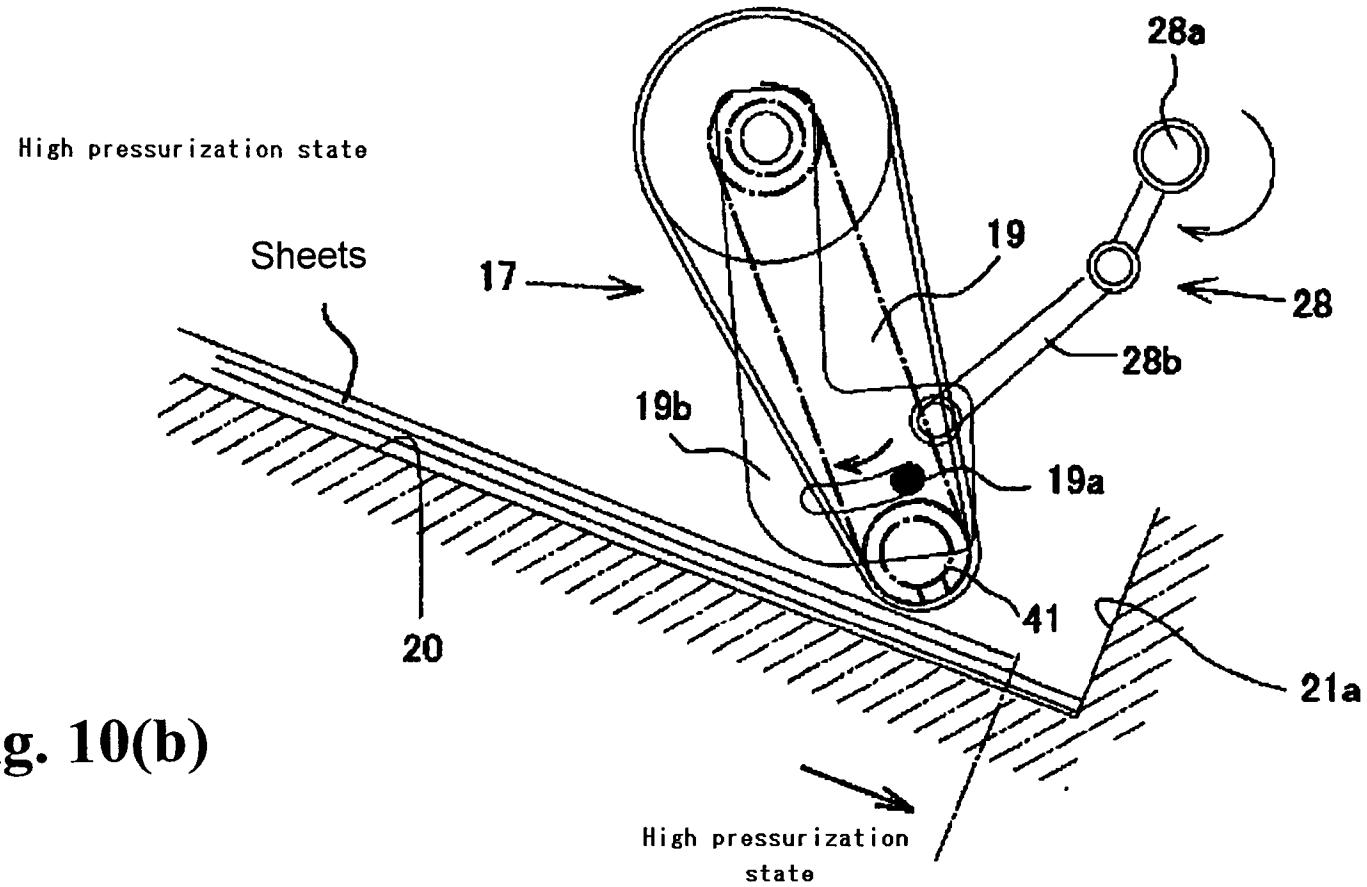

Thus, in the state shown in FIG. 10(*a*), a sheet is carried onto the processing tray 20 through the sheet discharging port 13. The forward and backward rotating roller device 26 then switches back and transfers the sheet in the reverse direction. Once the sheet trailing end advances to below the sheet feeding rotating member 17, the forward and backward rotating roller device 26 is withdrawn. At the same time, the control device 60 actuates the control motor M3 to allow the shift device 28 to move the sheet feeding rotating member 17 to the heavy pressurization state, shown in FIG. 10(*b*). The sheet is then transferred by the sheet feeding rotating member 17 toward the sheet end regulating member 21*a* in the heavy pressurization state.

Figure 11A:
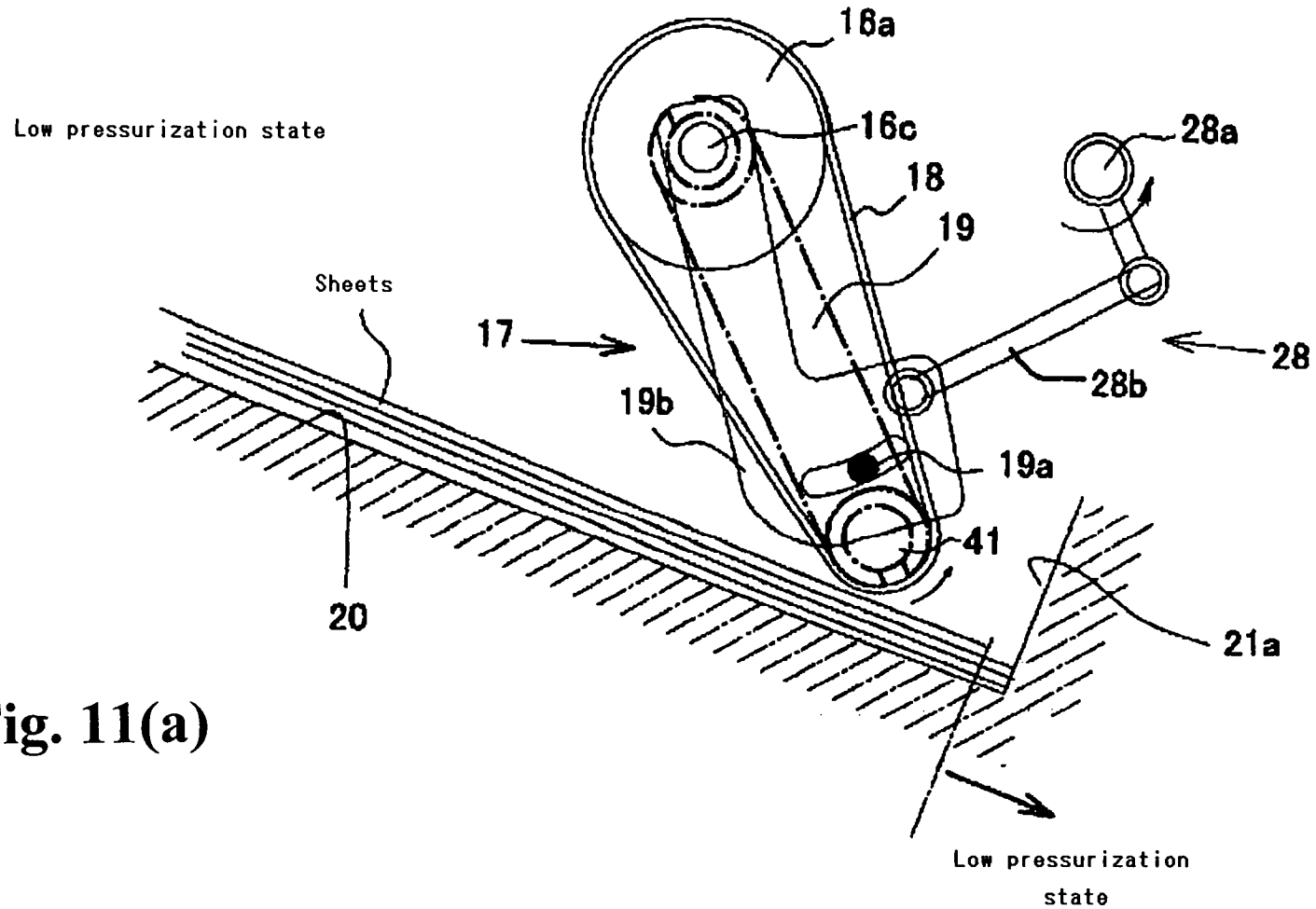
FIGS. 11(*a*) and 11(*b*) are diagrams illustrating operating states in the embodiment shown in FIGS. 10(*a*) and 10(*b*)
Figure 11B:
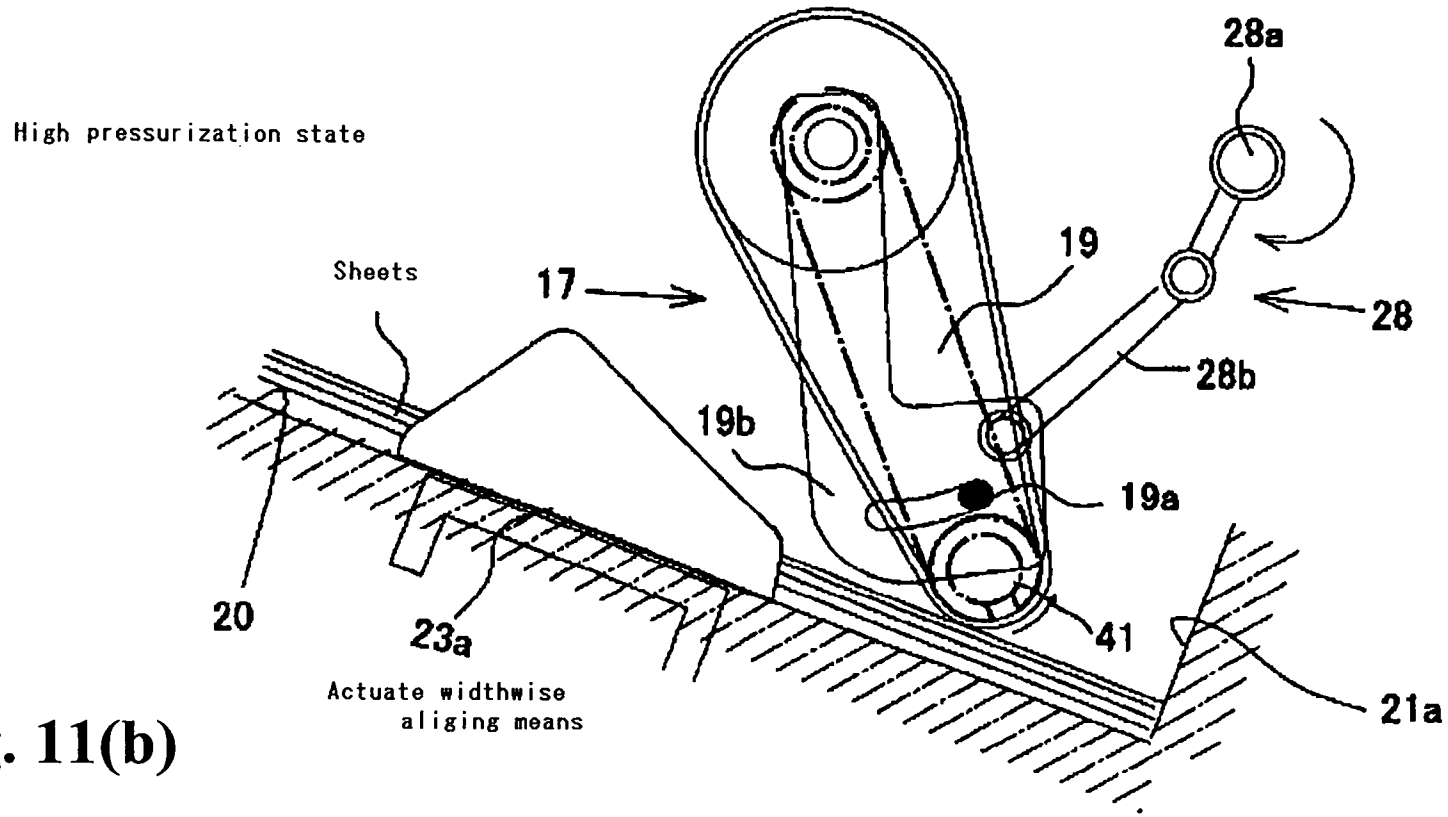
Figure 12:
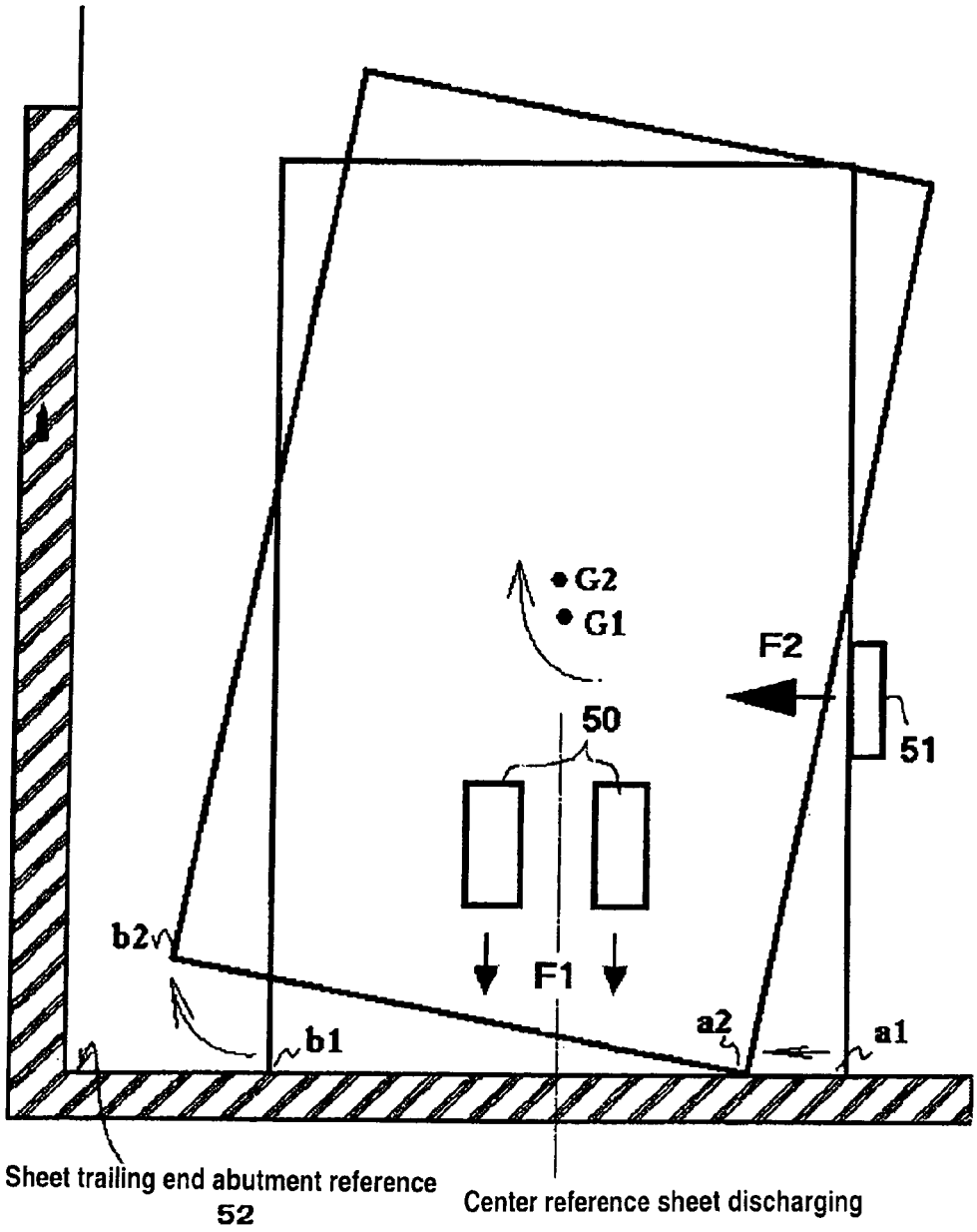
Fig. 12 Prior Art
FIG. 12 is a diagram illustrating a sheet aligning state in a conventional apparatus.

Then, after an expected time when the sheet trailing end approaches the sheet end regulating member 21*a*, the control device 60 reversely rotates the control motor M3 (counterclockwise in the figure) to move the sheet feeding rotating member 17 to the low pressurization state shown in FIG. 11(*a*). The rotating force of the sheet feeding rotating member 17 then acts on the sheet in the light pressurization state to allow the sheet to collide softly against the regulating member 21*a*. After the expected time when the sheet trailing end reaches the sheet end regulating member 21*a*, the control device 60 actuates the control motor M3 to rotate the shift device 28 clockwise to move the sheet feeding rotating member 17 to the heavy pressurization state shown in FIG. 11(*b*). The sheet feeding rotating member 17 then causes the sheet to collide hard against the sheet end regulating member 21*a*.

When the sheet trailing end collides hard against the sheet end regulating member 21*a*, the control device 60 actuates the driving motor M2 to move the widthwise aligning device 23 from the standby position Wp to an alignment position Sp. At this time, the sheet is moved in the width direction along the sheet end regulating member 21*a* without being skewed, to a predetermined position (post-processing position or jog position) for alignment. Then, after the widthwise movement is completed, the control device 60 moves the sheet feeding rotating member 17 to the withdrawal position shown in FIG. 10(*a*) so that the subsequent sheet can be carried out.

As described above, according to the present invention, (1) the sheet is transferred at a high speed by the sheet feeding rotating member 17 until the sheet trailing end abuts against the sheet end regulating member 21*a*. (2) Then, the conveying force applied to the sheet by the sheet feeding rotating member 17 is reduced, and the sheet is abutted against the sheet end regulating member 21*a* for alignment. At this time, the widthwise aligning device 23 starts moving the sheet toward the side regulating member 21*b*. (3) Then, the sheet feeding rotating member 17 presses the sheet against the sheet end regulating member 21*b* at a high speed or under a high pressure contact force. The widthwise aligning device 23 moves the sheet in the width direction for alignment. This allows the sheet to be orderly placed along the sheet end regulating device 21*a* while preventing damage to the sheet trailing end, for example, bending of the sheet trailing end and skewing of the sheet.

As described above, the present invention reduces the conveying force exerted on the sheet on the tray when the sheet abuts against the sheet end regulating device, and increases the conveying force when the sheet is moved for widthwise alignment. Consequently, the sheet carried onto the tray is transferred to the sheet end regulating device at a high speed in a short time by means of the sheet transfer device. Immediately before the sheet trailing end reaches the regulating device, the speed is reduced to transfer the sheet under a weaker conveying force. This prevents a thick sheet from being rebounded, while preventing the leading end of a thin sheet from being bent. Further, to place the sheet at the appropriate position for widthwise alignment, the sheet transfer device applies a strong conveying force to the sheet so that the sheet moves toward the regulating device at a high speed. The sheet thus moves in the orthogonal direction along the regulating device (regulating member or the like) while maintaining the appropriate posture. This prevents the sheet from being skewed.

The configuration required to exert the above effects varies the speed of the sheet feeding rotating member, which applies the conveying force to the sheet. The configuration has a simple structure and can be easily controlled. The present invention sets the speed at which the sheet is conveyed toward the regulating device higher than that at which the sheet is moved in the orthogonal direction by the widthwise aligning device. This enables the sheets to be orderly stacked on the tray, allowing the subsequent post-process to be executed at the exact position.

While the invention has been explained with reference to the specific embodiments of the invention, the explanation is illustrative and the invention is limited only by the appended claims.

What is claimed is:

1. A method of sheet alignment comprising the steps of:

carrying a sheet from a sheet discharging port;

transferring the sheet on a tray device toward a sheet end regulating device;

moving the sheet on the tray device in a width direction orthogonal to the sheet discharging direction for widthwise alignment; and abutting again the sheet on the tray device against the sheet end regulating device while the sheet is in the widthwise alignment;

wherein (1) when the sheet on the tray device is transferred toward the sheet end regulating device, the sheet is transferred at a predetermined speed, (2) before the sheet abuts against the sheet end regulating device, the predetermined speed is reduced to provide a conveying force to the sheet without stopping, (3) after the sheet abuts against the sheet end regulating device with said conveying force, the conveying force applied to the sheet is increased, and (4) while the conveying force is being applied continuously to the sheet, the sheet is aligned in the width direction to thereby prevent skewing of the sheet relative to the sheet end regulating device.

2. The method of sheet alignment according to claim 1, wherein the step of transferring the sheet on the tray device toward the sheet end regulating device is made by a sheet feeding rotating member, and the conveying force applied to the sheet is varied by changing a speed of the sheet feeding rotating member or a pressure applied to the sheet feeding rotating member.

3. The method of sheet alignment according to claim 1, wherein the conveying force applied to the sheet is made so that the sheet is prevented from being bent upon abutting against the sheet end regulating device.

4. A method of post-processing a sheet comprising the steps of:

aligning the sheet on the tray device according to claim 1, and executing a post-process including stapling or punching on each of sheets placed on a processing tray.

5. The method of sheet alignment according to claim 1, further comprising the steps of receiving the sheet ejected from the sheet discharge port in a sheet discharging direction, and transferring the sheet on the tray device in a direction opposite to the sheet discharging direction.

6. The method of sheet alignment according to claim 1, wherein the step of transferring the sheet on the tray device toward the sheet end regulating device is made by a sheet feeding rotating member, when the sheet on the tray device is transferred toward the sheet end regulating device, the sheet is transferred at a high speed, before the sheet abuts against the sheet end regulating device, the sheet is transferred at a speed lower than the high speed, and after the sheet abuts against the sheet end regulating device, the sheet is applied with a force at said high speed wherein when the sheet is aligned in the width direction, the sheet is applied with said force at said high speed.

7. The method of sheet alignment according to claim 6, wherein an operation speed of the sheet feeding rotating member when transferring the sheet at the high speed is faster than a moving speed of an aligning plate in the width direction.

8. The method of sheet alignment according to claim 6, wherein an operation speed of the sheet feeding rotating member when transferring the sheet on the tray device toward the sheet end regulating device is equal to an operation speed of a widthwise alignment of the sheet with an aligning plate.

9. The method of sheet alignment according to claim 6, wherein at the high speed, the sheet feeding rotating member rotates at 700 mm/sec, and at the low speed, the sheet feeding rotating member rotates at 500 mm/sec.

* * * * *